US011291897B2

(12) United States Patent
Lyons et al.

(10) Patent No.: US 11,291,897 B2
(45) **Date of Patent: *Apr. 5, 2022**

(54) HOCKEY PUCK REBOUNDER AND TRAINING DEVICE

(71) Applicant: Krusader LLC, Ladera Ranch, CA (US)

(72) Inventors: Craig M. Lyons, San Clemente, CA (US); Marko R. Zoretic, Coto de Caza, CA (US); Luka J. Zoretic, Coto de Caza, CA (US)

(73) Assignee: Krusader LLC, Ladera Ranch, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/983,306

(22) Filed: Aug. 3, 2020

(65) Prior Publication Data

US 2020/0360786 A1 Nov. 19, 2020

Related U.S. Application Data

(63) Continuation-in-part of application No. 15/841,910, filed on Dec. 14, 2017, now Pat. No. 10,737,161.

(60) Provisional application No. 62/525,694, filed on Jun. 27, 2017, provisional application No. 62/434,946, filed on Dec. 15, 2016.

(51) Int. Cl.

| | |
|---|---|
| ***A63B 69/00*** | (2006.01) |
| ***A63B 71/02*** | (2006.01) |
| ***A63B 71/00*** | (2006.01) |

(52) U.S. Cl.

CPC ..... *A63B 69/0026* (2013.01); *A63B 69/0097* (2013.01); *A63B 71/023* (2013.01); *A63B 71/0036* (2013.01); *A63B 2071/024* (2013.01); *A63B 2071/026* (2013.01); *A63B 2209/08* (2013.01); *A63B 2209/10* (2013.01); *A63B 2210/50* (2013.01)

(58) Field of Classification Search

CPC ..... A63B 69/0026; A63B 69/0097; A63B 69/0024; A63B 63/00; A63B 63/004

USPC ..... 473/164, 446, 435, 497

See application file for complete search history.

(56) References Cited

U.S. PATENT DOCUMENTS

2005/0192125 A1* 9/2005 Valliquette ..... A63B 69/0097 473/446

FOREIGN PATENT DOCUMENTS

FR 2738750 A1 * 3/1997 ..... A63B 69/0026

* cited by examiner

*Primary Examiner* — John E Simms, Jr.
*Assistant Examiner* — Rayshun K Peng
(74) *Attorney, Agent, or Firm* — Perkins Coie LLP

(57) ABSTRACT

Hockey puck rebounders and training devices are capable of rebounding playing objects, such as hockey pucks or balls. Aspects of the technology are directed to training devices that can be used on ice surfaces or synthetic ice surfaces to practice various skills. The training device can include a frame, anchors, and rebound panels mounted to a tubular frame. The anchors can secure the training device to the ice surface. Hockey pucks can be rebounded off the rebound member by a player.

20 Claims, 22 Drawing Sheets

HOCKEY PUCK REBOUNDER AND TRAINING DEVICE

CROSS-REFERENCE TO RELATED APPLICATIONS

This application is a continuation-in-part of U.S. patent application Ser. No. 15/841,910 filed on Dec. 14, 2017, entitled "HOCKEY PUCK REBOUNDER AND TRAINING DEVICE," which claims the benefit of U.S. Provisional Patent Application No. 62/434,946 filed on Dec. 15, 2016, entitled "HOCKEY PUCK REBOUNDER AND TRAINING DEVICE," and U.S. Provisional Patent Application No. 62/525,694 filed on Jun. 27, 2017, entitled "HOCKEY PUCK REBOUNDER AND TRAINING DEVICE," all of which are incorporated herein by reference in their entireties.

TECHNICAL FIELD

The present invention relates generally to a hockey-training device and more specifically to a device that rebounds a playing object, such as a hockey puck or a ball.

BACKGROUND

Shooting, passing, and receiving are essential hockey skills. These skills are typically practiced with players and coaches working together. Unfortunately, it may not always be possible for a player to practice such activities with another player or coach, and a coach may desire that a player practice such activities on their own. Thus, there is a need for a device that allows a player to practice their shooting, passing, and receiving skills on their own. There is also a need for a device that allows players to develop their skills in an environment that provides consistent feedback, which may not be achievable with another player or coach.

SUMMARY

At least some embodiments are a training device configured to rebound playing objects. The training device can be secured to a support surface such that it is not displaced when impacted by a playing object. The training device can include a hockey puck rebounder secured to, for example, an ice surface, synthetic ice, or the like.

The training device can be used to practice various skills and can provide consistent feedback that may not be achievable using another player or coach. For example, the training device can be used by a single player to practice shooting, passing, receiving, etc. In some training routines, the training device can be simultaneously used by multiple players by, for example, rebounding hockey pucks off opposite sides of the training device. Targets can be mounted on a rebounder or another component of the training device. For example, removable or permanent target markings can be located along resilient faces of the rebounder. The training device can include one or more rebound members with one or more markings designating targets and/or target areas.

In some embodiments, the training device includes a rigid frame (e.g. a tubular metal frame) capable of deflecting hockey pucks with substantially no permanent deformation of the training device. One or more panels (e.g., rebounding panels) can overlay the frame to limit or substantially prevent damage to the rebounded object and/or frame. Additionally, the panel can provide a relatively high-wear resistant surface that manages impact noise. The design, configuration, and composition of the various components of the training device can be selected based on the desired rebounding characteristics, wear characteristics, coefficient of restitution, combinations thereof, or the like. In one example, the coefficient of restitution of the hockey puck-training device and hockey puck can be equal to or greater than about 0.6, 0.7, 0.8, 0.9, or 0.95.

In some embodiments, a portable hockey-training device for rebounding objects includes an elongate tubular frame, one or more ice-penetrating anchors, a handle, a stepping pad, and a rebound panel. The ice-penetrating anchors and the handle can be coupled to the frame. The stepping pad can be pressed upon by a user to drive the ice-penetrating anchors into an ice surface. In certain embodiments, the rebound panel is coupled to the frame such that it covers one side of the frame and may include an exposed surface configured to be substantially perpendicular to the ice surface. The rebound panel can be at other orientations selected based on the training skills to be practiced.

The ice-penetrating anchors can be positioned generally under one stepping pad, all the stepping pads, or a certain number of stepping pads when a bottom side of the frame is at a substantially horizontal orientation. This allows the user to conveniently drive the anchors into the ice by stepping on the stepping pads. The rebound panel can be positioned to deflect a hockey puck moving along an ice surface when the ice-penetrating anchors extend into the ice surface.

The rebound panel can extend along most of a longitudinal length of the frame. The rebound panel can include a bottom edge that is positioned to be substantially flush with the ice surface when the anchors are seated. In certain embodiments, the bottom edge is adjacent to or contacts the ice surface during use.

In further embodiments, a hockey-training device includes a tubular frame having a top side, a bottom side, and two sides between the top and bottom sides. The training device can further include anchors, a rebound member, and one or more pads, such as stepping pads (e.g., flat platforms or plates). The anchors can be coupled to a bottom side of the tubular frame. The rebound member can be secured to one of the sides and can include a face configured to be at a desired orientation with respect to a playing surface. The stepping pads can be coupled to the top side of the tubular frame and can be generally horizontal when the anchors are seated in the ice. The stepping pads can extend across most or all of the width of the frame and/or rebound panels. In one embodiment, the stepping pads cover the entire width of the hockey-training device.

The anchors can be positioned generally under one or more stepping pads when the bottom side of the frame is at a substantially horizontal orientation. In some embodiments, the rebound member extends along most of the longitudinal length of the tubular frame and includes a bottom edge positioned to be adjacent to and/or substantially flush with the playing surface when the anchors are fully seated. The rebound panel can be made of one or more materials that are more compliant than material of the frame. In one embodiment, the tubular frame is positioned directly between opposing rebound members such that either side of the training device can be used to rebound playing objects.

In yet further embodiments, a training device has an elongate configuration and opposing sides for rebounding objects. The training device is portable and can be secured to surfaces to limit, minimize, and substantially prevent movement of the training device during use. Each side can include a panel that is generally perpendicular to a support surface upon which the training device rests. The panel can be permanently or detachedly coupled to an elongate frame that provides a relatively high coefficient of restitution for rebounding objects traveling at a relatively high speed. In certain embodiments, the training device has one or more pass-through features through which objects can travel to practice accuracy (e.g., passing accuracy, shooting accuracy, etc.). Additionally or alternatively, the training device can include one or more targets mounted on a rebounder. The targets can be used to practice high shots, passing, or other desired skills.

In some embodiments, a training device includes an elongate frame and a rebound member. The elongate frame includes two sides, a bottom, and a pass-through opening that allows a playing object to pass through or underneath the elongate frame. The rebound member can be secured to one of the sides, surrounds the pass-through opening, and is positioned to be substantially perpendicular to a support surface. The rebound member can include one or more rebound panels mounted on one side or opposite sides of the frame. The pass-through opening can extend between two opposing sides of the frame and can be dimensioned to allow a hockey puck to pass therethrough. The length and height of the pass-through opening can be increased or decreased to decrease or increase, respectively, the difficulty level. In certain embodiments, the training device is configured for placement on ice. The training device can include spikes, feet, or other features suitable for engaging ice. In other embodiments, the training device is configured for off-ice use and can include one or more pads for placement on cements, wood floors, etc.

In certain embodiments, a device includes a frame, a rebound member, a target, and a target holder. The rebound member can be coupled to the frame and is configured to be an orientation suitable for rebounding objects travelling along a support surface. The target can be coupled to the frame by the target holder. The target can be held above the frame and sized to practice hockey passes, shots, etc.

The frame can have a top side, a bottom side, and two sides between the top and bottom sides. The rebound member can be coupled to one of the sides such that the rebound member is generally perpendicular to the support surface. The target can be positioned generally above a center line, longitudinal axis, etc. of the frame and at a suitable height for practicing, for example, shots. The target holder can be a rigid or flexible frame removably or permanently coupled to the frame.

In yet further embodiments, a hockey-training device includes an elongate hollow frame having two sides, a bottom, and a top. The hockey-training device can include a rebound member and a fastener configured to pass through an opening in the elongate frame such that the rebound member is fixedly coupled to one of the sides of the elongate hollow frame. In one embodiment, the opening and a shaft of the fastener have complementary shapes. For example, the opening and shaft can both have substantially polygonal shapes (e.g., square or rectangular shapes).

The fastener can include a bolt and a nut, and the bolt can be dimensioned to pass through the opening in the elongate frame and to be threadably coupled to the nut. The rebound member can include an object-deflecting layer, an intermediate layer coupled to the deflecting layer, and a base layer coupled to the intermediate layer. The head of the fastener is embedded within the rebound member. The object-deflecting layer can be made, in whole or in part, of metal, plastic, composites, combinations thereof, or other suitable materials. The hollow frame can be an extruded tubular member.

BRIEF DESCRIPTION OF THE DRAWINGS

Aspects and advantages are described below with reference to drawings of various embodiments, which are intended to illustrate but not to limit the present technology. Identical reference numbers identify similar elements or acts.

DETAILED DESCRIPTION

Figure 1:
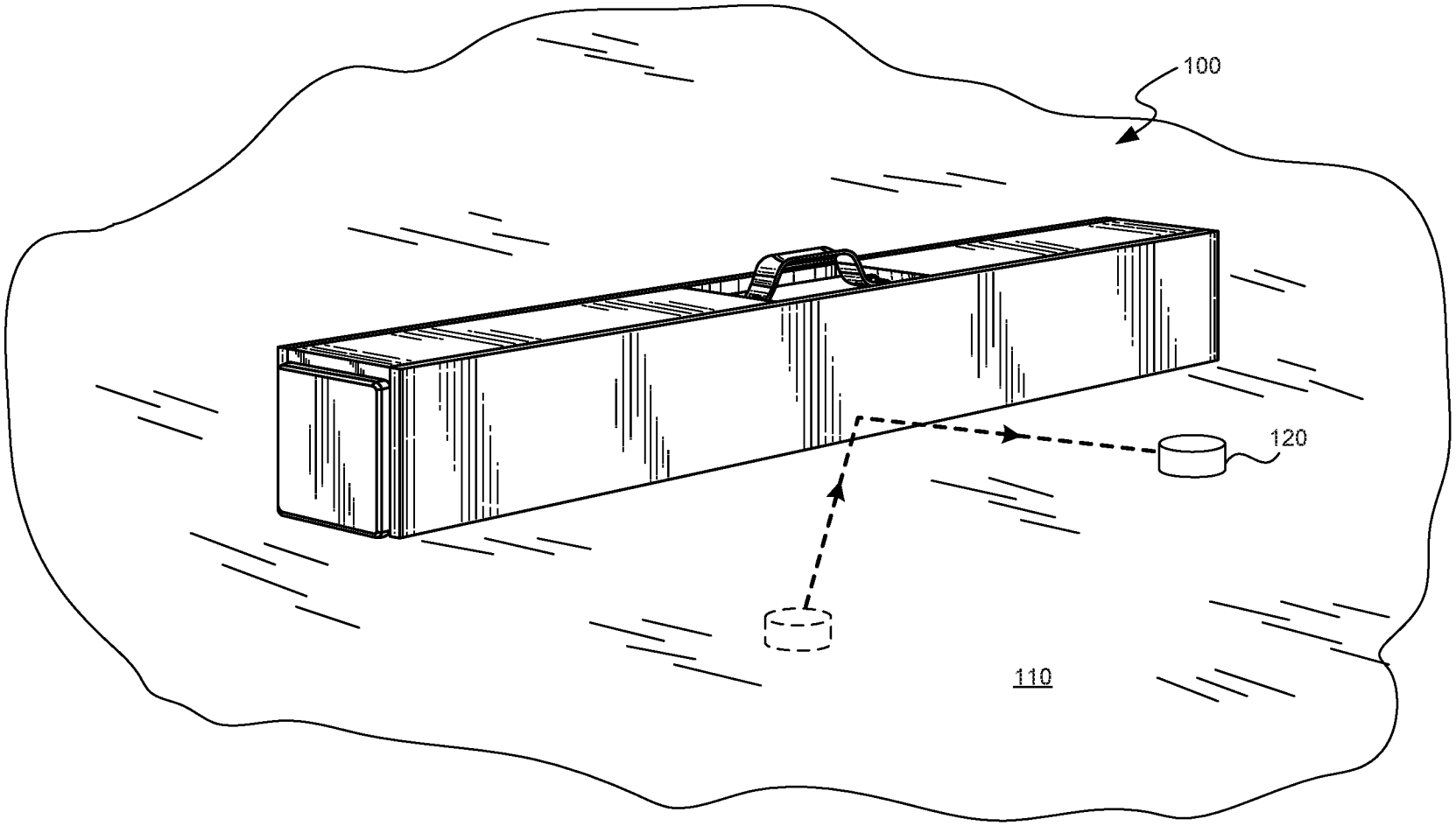
FIG. 1 is a perspective view of a rebounding device on a playing surface in accordance with an embodiment of the technology.

FIG. 1 is a perspective view of a rebounding device 100 on a playing surface 110 in accordance with an embodiment of the technology. The rebounding device 100 can deflect a playing object in the form of a hockey puck 120 to practice hockey skills, such as shooting, passing, and receiving. The rebounding device 100 can be secured to the playing surface 110 to provide consistent rebounding at a wide range of angles. A user can conveniently transport and install the rebounding device 100. After use, the user can conveniently lift the rebounding device 100 away from the surface 110.

Figure 2:
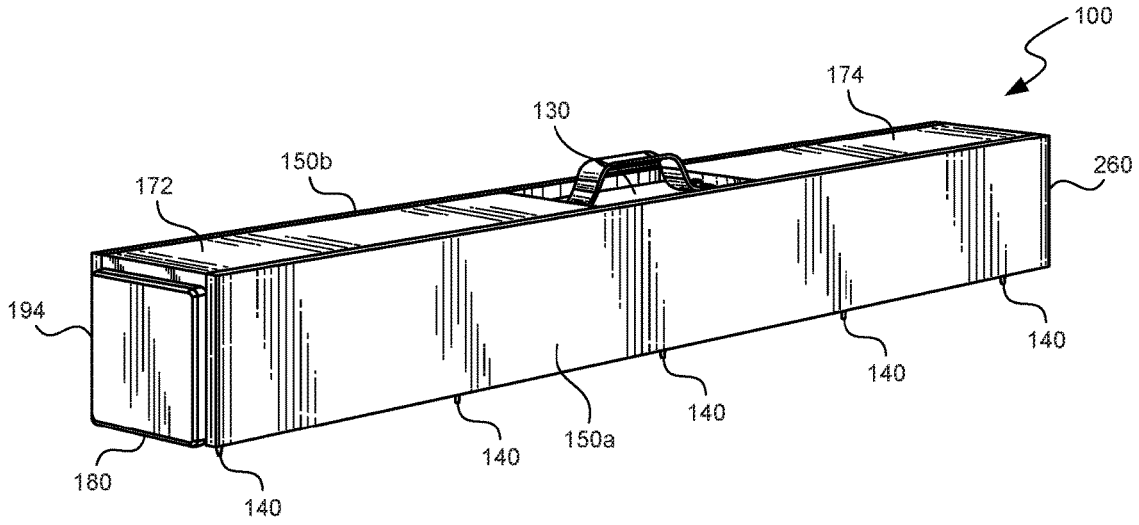
FIG. 2 is a perspective view of a rebounding device in accordance with an embodiment of the technology.
Figure 3:
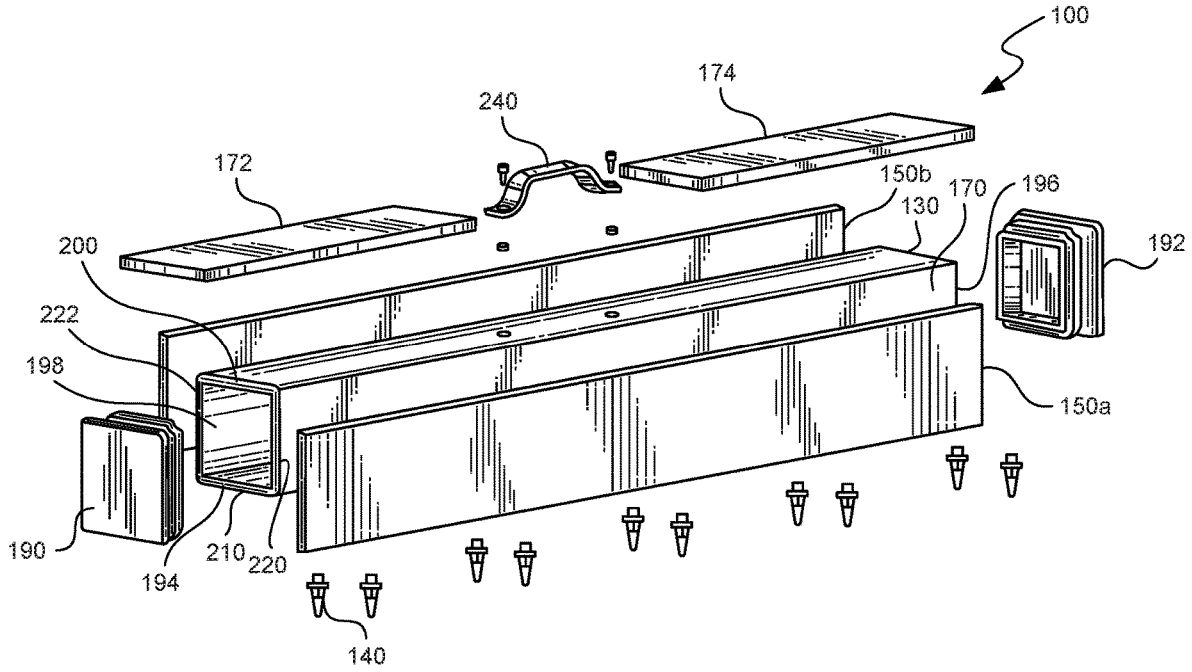
FIG. 3 is an exploded isometric view of the rebounding device of FIG. 2.

FIG. 2 is a perspective view of the rebounding device 100 in accordance with one embodiment of the technology. FIG. 3 is an exploded isometric view of the rebounding device 100. Referring to FIGS. 2 and 3, the rebounding device 100 can include a frame 130, anchors 140, and rebound members 150*a*, 150*b* (collectively "rebound members 150"). The rebound members 150 are coupled to opposite sides of the frame 130 and the description of the rebound member 150*a* applies equally to the rebound member 150*b*, unless indicated otherwise.

The rebound member 150*a* acts as a rebounding surface and can remain generally flat when impacted. Playing objects can be consistently rebounded at expected angles, even when traveling at high speeds. In some embodiments, the rebound member 150*a* does not extend past the bottom side of the frame 130 so that the anchors 140 can be fully inserted into the ice. In some embodiments, the rebound member 150*a* is configured to rest upon or be very close to the ice surface when the anchors 140 are seated in the ice. This limits or substantially prevents tips of ice hockey sticks becoming stuck between the rebound member 150*a* and the ice surface.

As shown in FIG. 2, two rebounding members 150*a*, 150*b* allow multiple players to use the rebounding device 100 at the same time, as well as a single player to use both rebounding members 150*a*,150*b* in particular drills. The rebounding device 100 could have more than two rebounding members, for example, if the tubular frame is formed in the shape of a triangle, pentagon, hexagon, octagon, etc. In one-sided embodiments, the rebounding device 100 may include a single rebounding member. For example, the rebounding device 100 could include the rebounding member 150*a* and the rebounding member 150*b* can be eliminated.

The rebound member 150*a* can be a monolayer or multilayer member comprising, in whole or in part, rubber, such as Ethylene Propylene Diene Monomer (EPDM) rubber, recycled rubber, styrene butadiene rubber (SBR), and/or neoprene. In one embodiment, the rebound member 150*a* is in the form of a monolayer panel covering most of the side of the tubular frame 130 and comprises mostly rubber by weight. For example, the rebound member 150*a* can be a rubber panel that is about 0.25, 0.375, or 0.5 inch thick, and the rubber can have a hardness in the range between about 50 to 70 Shore A, 50 to 60 Shore A, or 60 to 70 Shore A. In some multilayer embodiments, the rebound member 150*a* can include multiple layers of rubber, polymer, metal, or the like. The number of layers and composition of each layer can be selected based on the desired rebounding characteristics, wear characteristics, sound characteristics, etc. For example, the rebound member 150*a* can have an outer layer with high-wear characteristics and an underlying layer designed to absorb energy to reduce excessive noise when impacted.

The rebound members 150 can be secured to the tubular frame 130 in multiple ways. According to some embodiments, an adhesive couples the rebound members 150 to the tubular frame 130. The adhesive can be adapted to withstand cold and wet environments associated with ice surfaces. Fasteners can couple the rebound members 150 to the tubular frame 130 and can include one or more screws, bolts, rivets, clips, etc. Washers (e.g., plain washers, fender washers, and/or countersunk washers) could be used on the rebound member surface in order to distribute loads. In some embodiments, a combination of adhesive and fasteners could be used to secure the rebound members 150 to the tubular frame 130. The method of securing the rebound members 150 to the tubular frame 130 can be selected to not interfere with practice.

FIG. 3 shows the frame 130 including a top side 200, a bottom side 210, and two sides 220, 222 substantially perpendicular to and between the top and bottom sides 200, 210. The frame 130 can be an elongate tubular frame with a generally square shape, rectangular shape, or the like. In some embodiments, the frame 130 is a 4-inch square tube that is about 36 inches long and about 3/16-inch thick. The rebound member 150*b* can cover most of or the entire side 220 of the frame 130 and can have a length of about 34 to 36 inches, a width or height of about 3.5 to 4 inches, and a thickness equal to or less than about 0.3, 0.4, or 0.5 inch. In another embodiment, the frame 130 can have a smaller profile and can be, for example, a rectangular elongate member (e.g., a standard 2×5 inch rectangular tube) with a relatively short length, such as 30 inches, 24 inches, or 18 inches. The dimensions and configuration of the frame 130 can be selected based on the desired rebounding area.

The frame 130 can include, in whole or in part, metal, rigid plastics, composites (e.g., fiber-reinforced composite, carbon fiber reinforced thermoplastic, etc.), or another material capable of supporting the rebounding members 150. Non-limiting exemplary metals include, without limitation, stainless steel, aluminum, or other metals that promote stability of the rebounding device 100 such that when a playing object impacts the rebound member 150*a*, the rebounding device 100 is able to withstand the impact and remain generally stable on the playing surface. Accordingly, the rebounding device 100 can remain securely coupled to the playing surface while repeatedly deflecting playing objects, such as hockey pucks traveling at speeds equal to or greater than 40 mph, 60 mph, 70 mph, or the like.

The tubular frame 130 can be lightweight for convenient transport. In some embodiments, the tubular frame 130 weighs less than about 30 pounds, 25 pounds, or 20 pounds. For a tubular frame with a length equal to or greater than 24 inches, one suitable material is 3/16-inch thick steel (e.g., carbon steel, alloy steel, stainless steel, etc.). For a 2×5 inch rectangular tubular frame that is less than about 24 inches long, one suitable material is ¼-inch thick steel. According to some embodiments, the tubular frame 130 can have surface finishes and/or treatments, such as being painted, plated, or have another finishing such as powder coat or the like.

As explained in more detail below, anchors 140 (five identified in FIG. 2 and one identified in FIG. 3) cooperate to limit or prevent movement of the rebounding device 100. The anchors 140 can be spikes or cleats positioned on the underside surface 180 (FIG. 2) of the tubular frame 130 as a means to secure the rebounding device 100 to an ice surface so that the rebounding device 100 is not displaced when impacted by a playing object.

Weights can be placed on or secured to the frame 130, including the inside of the tubular frame 130, to provide the sufficient weight/mass to achieve desired stability. If the rebounding device 100 is not sufficiently stable because it does not have sufficient weight/mass, weights can be mechanically, magnetically, or otherwise coupled to the frame 130. By way of example, weights can be placed at the bottom of the tubular frame 130 to lower the moment of inertia of the rebounding device 100. Weights can be positioned immediately adjacent to (e.g., above) the anchors to minimize, limit, or substantially prevent vibrations. As such, the weights can function as dampeners to further increase stability of the rebounding device 100. Weights and anchors 140 can be positioned at locations selected to achieve the desired stability.

Referring now to FIG. 3, the rebounding device 100 can include two endcaps or plugs 190, 192 securable to frame ends 194, 196, respectively. The two plugs 190, 192 can reduce, limit, or substantially prevent noise produced by the rebounding device when it is struck by an object. Additionally or alternatively, the plugs 190, 192 can be endcaps that protect the inner portions of the frame 130 from contaminants, such as moisture. When the rebounding device 100 is used in a wet setting (e.g., a skating rink) the two plugs 190, 192 can prevent water from entering a passageway 198 of the frame 130. In embodiments in which weights are placed inside the frame 130, the end plugs 190, 192 can help contain the weights during use, transport, or the like.

The plugs 190, 192 can be made, in whole or in part, of rubber, plastic, metal, composites, or other suitable materials and can include coupling or sealing features. Coupling features include, without limitation, snaps, clips, or combinations thereof. Sealing features can be configured to form a desired seal (e.g., a watertight seal, a liquid-tight seal, an airtight seal, etc.) with the frame 130. In one embodiment, the plugs 190, 192 include one or more ribs configured to provide a secure fit and are made of a polymer, such as low density polyethylene. In other embodiments, the tubular frame 130 can be closed by another means, for example, by way of a welded metal sheet, plastic caps, vinyl caps, etc. In other embodiments, the frame 130 can be designed to be open during use. In one embodiment, the frame 130 can be made of stainless steel or can be painted to inhibit corrosion.

In yet further embodiments, one or both ends of the tubular frame 130 can be permanently sealed or closed. In other embodiments, one end can include an access feature that allows access to the passageway 198. The access feature can be a door or panel that can be opened to provide access to the passageway 198, which can serve as a storage compartment. The door can be removable or hingeably coupled to the frame 130. Additionally, one or more walls can be positioned along the passageway 198 to provide a plurality of separate compartments. The walls can extend across the passageway 198 and can be generally perpendicular to a longitudinal axis of the frame 130. The compartments can be used to store a variety of items, such as hockey pucks, balls, weights, targets, target frames, couplers for rebounding devices, vibration dampeners, tools, replacement anchors or other playing objects.

According to some embodiments, including the embodiment of FIG. 3, the rebounding device 100 can further include a handle 240 secured to the top side 200 of the frame member 130. The handle 240 can be positioned generally midway between frame ends 194, 196 of the rebounding device 100. The handle 240 can be large enough to accommodate handling by a person wearing a hockey glove so that the hockey glove does not need to be removed in order to handle the rebounding device 100. According to some embodiments, the handle 240 is a folding pull handle that drops out of the way when the handle is released. It will be appreciated that a low profile or folding pull handle may be desirable when players practice flip or saucer passes over the device 100, such that the handle does not interfere with the flip or saucer pass. According to some embodiments, the folding pull handle comprises a grip, such as one made from rubber or plastic, which dampens any vibration of the handle when the rebounding device 100 is impacted by a playing object. According to some embodiments, the handle is a recessed pull handle. According to some embodiments, a handle is formed by creating one or more openings on the top of the tubular frame, such as an elongated oval or rounded rectangular opening, sufficient to allow the user to insert his/her fingers through the one or more openings to grasp the tubular frame. The position, configuration, and size of the handle can be selected based on the desired carrying capabilities (e.g., while wearing a glove), overall weight of the training device 100, or other desired functionality.

Figure 4:
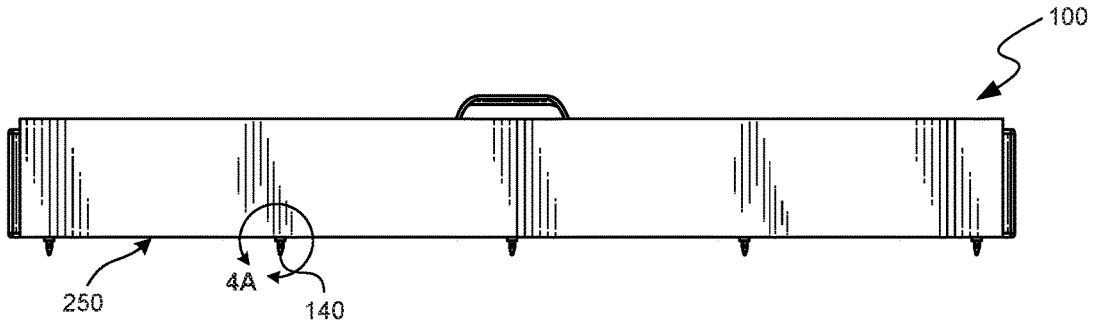
FIG. 4 is a side view of the rebounding device of FIG. 2.
Figure 4A:
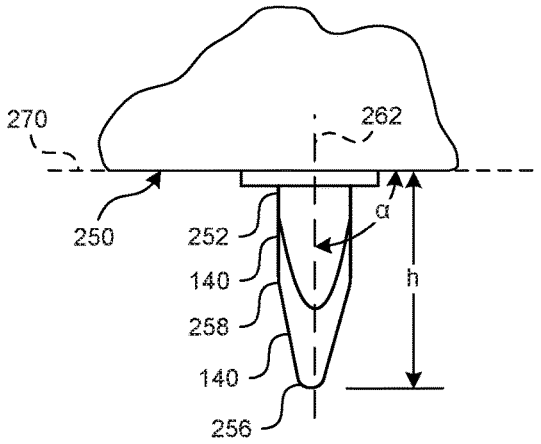
FIG. 4A is a detailed view of a portion of the rebounding device of FIG. 4.

FIG. 4 is a side view of the rebounding device 100. FIG. 4A is a detailed view of one of the anchors 140. Referring to FIGS. 4 and 4A, the anchor 140 extends downwardly from a bottom surface or underside 250, which is configured to lay flat on a support surface, such that the anchors 140 cooperate to keep the rebounding device 100 secured to the support surface. In some embodiments, the anchor 140 has a height h (FIG. 4A) equal to or greater than about 0.1, 0.25, 0.5, 0.75, or 1 inch. In one embodiment, the height h is less than about 0.25 or 0.5 inch to limit disruption or damage to underlying ice. In another embodiment, the height h is less than about 0.75 inch. The height h can be selected based on the desired stability, effect to ice surface, etc.

FIG. 4A shows the anchor 140 having a base 252, a tip 256, and a main body 258 extending therebetween. The base 252 can be coupled to the frame 130 (FIG. 3) or another part of the rebounding device 100. The main body 258 extends away from the bottom surface 250 in a direction generally parallel to the anchor's longitudinal axis 262. In certain embodiments, the longitudinal axis 262 is substantially perpendicular to a plane 270 in which the bottom surface 250 lies. An angle α defined by the plane 270 and the longitudinal axis 262 can be about 90°±5°. In one embodiment, the angle α is about 90°±2°. The tip 256 can be an ice penetrating tip, which is sufficiently sharp to penetrate ice but can be sufficiently rounded to inhibit inadvertent injury if it comes in contact with a person. The orientation, length, and configuration of the anchor 140 can be selected based on the characteristics of the support surface upon which the rebounding device 100 will be installed.

Figure 5:
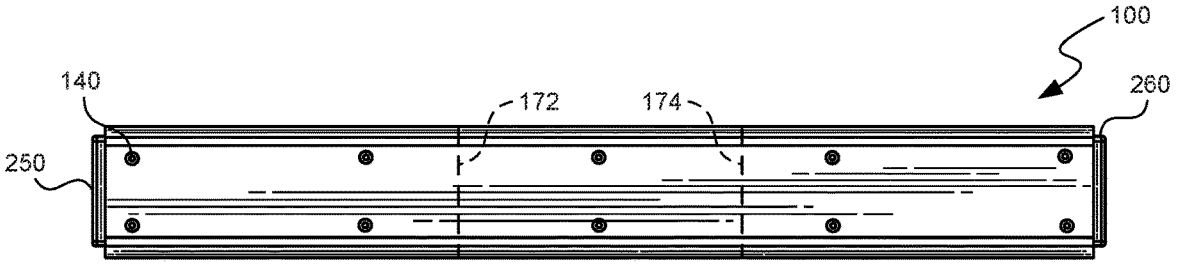
FIG. 5 is a bottom view of the rebounding device of FIG. 2.

The anchors 140 can be spaced evenly or unevenly from one another. FIG. 5 shows the anchors 140 (one identified in FIG. 5) spaced evenly apart from one another. Most of the anchors 140 can be positioned directly below the stepping pads 172, 174. The positions of the stepping pads 172, 174 are indicated by phantom lines. As shown in FIG. 5, four anchors 140 are positioned below the stepping pad 172, and another four anchors are positioned under the stepping pad 174. When a user pushes down on the stepping pad 172, the four anchors 140 therebelow can be conveniently pressed into an ice surface. The user can press on the stepping pad 174 to press the four anchors 140 therebelow into the ice surface. In other embodiments, the rebounding device 100 has only four anchors 140 at each corner. Each of the stepping pads 172, 174 can be stepped upon to press two anchors into the ice surface. The number, positions, dimensions, and pattern of the anchors 140 can be selected based on the desired force needed to seat the anchors. Additionally, the anchors 140 can have the features and configurations discussed in connection with FIGS. 8-12.

Figure 6:
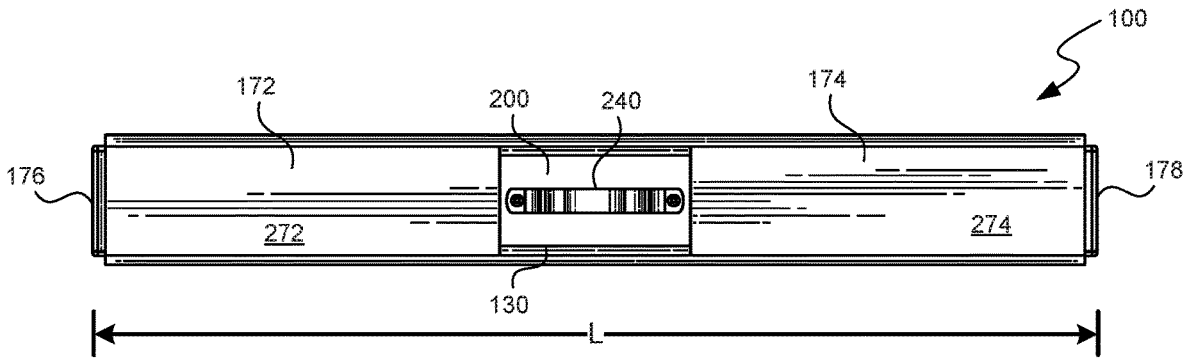
FIG. 6 is a top view of the rebounding device of FIG. 2.

FIG. 6 is a top view of the rebounding device 100. The handle 240 is positioned between the stepping pads 172, 174, which are coupled to the top side 200 of the frame 130. The stepping pads 172, 174 can be stepped upon by, for example, hockey skates in order to provide downward pressure on the rebounding device 100. A sufficient amount of force can be applied to drive the anchors 140 into an ice surface 110 (shown in phantom line in FIG. 7). In some embodiments, the stepping pads 172, 174 can be made, in whole or in part, of rubber sufficiently thick to prevent an ice hockey skate blade from cutting through the stepping pad and potentially damage the skate blade. In some embodiments, the stepping pads 172, 174 can have an upper compliant layer (e.g., a silicone layer, a rubber layer, or the like) and can have one or more layers between the upper layer and the frame 130. The additional layers can include, without limitation, an adhesive layer, a barrier layer, a plate (e.g., a plastic plate) or the like. Additionally, the stepping pads 172, 174 can have relatively high coefficients of friction to inhibit, limit, or substantially prevent relative movement of the hockey skates when the user steps up onto, jumps on, or otherwise applies pressure to the rebounding device 100. The materials and configuration of the stepping pads 172, 174 can be selected to provide the gripping action without damaging skates, without slipping, and without damaging (e.g., padding, penetrating, or the like) surfaces 272, 274 (FIG. 6) of the stepping pads 172, 174, respectively, during installation of the rebounding device 100.

Figure 7:
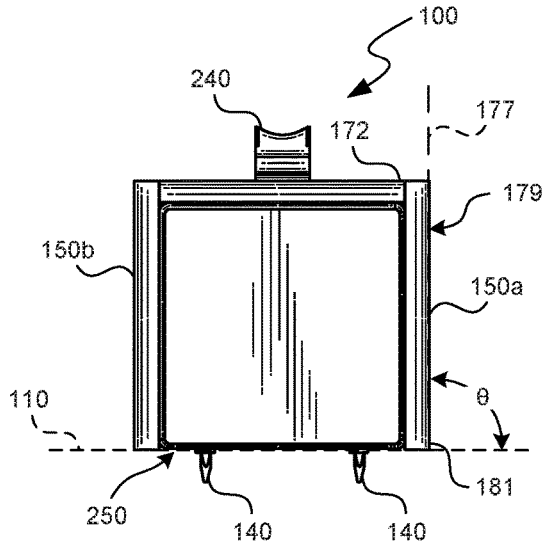
FIG. 7 is a front view of the rebounding device of FIG. 2.

FIG. 6 shows stepping pad 172 extending across most of the distance between the endcap 176 and the handle 240, and the stepping pad 174 extending across most of the distance between the endcap 178 and the handle 240. Each of the stepping pads 172, 174 can extend across most or substantially the entire width of the underlying frame 130, as shown in FIGS. 6 and 7. This prevents the user's metal skates from coming into contact with exposed metal surfaces of the frame 130. Additionally, the upper surfaces of the stepping pads 172, 174 can be generally coplanar with each other so that a user can remain balanced when both feet are placed on the stepping pads 172, 174.

As shown in FIG. 6, the stepping pads 172, 174 provide relatively large surfaces upon which a user can press. For example, a ratio of the combined length of the stepping pads to a longitudinal length L of the device 100 can be equal to or greater than about 0.95, 0.9, 0.8, or 0.7. Other ratios can be selected based on the desired stepping area. Additionally or alternatively, the stepping pads 172, 174 can include, without limitation, one or more anti-slip features (e.g., texturing, friction elements, etc.), high friction coatings, or other features suitable for providing desired interaction with a user's skates. Accordingly, most of the exposed upper surfaces of the rebounding device 100 are suitable for being stepped upon by a player for convenient securement to surfaces.

Refer now to FIG. 7, when the anchors 140 are fully seated in ice surface 110, a surface 179 of the rebound member 150*a* lies in a plane 177 generally perpendicular to the support surface 110. In some environments, the plane 177 and surface 110 define an angle θ in a range of about 85° to 95°, 88° to 92°, or 89° to 91°. In some environments, the rebound member 100 is configured to define angle θ of about 90° (e.g. 90°±2°) when each of the anchors 140 are fully seated. This allows a playing object to be kept on or near the surface 110 when it is deflected off of the surface 179.

A lower portion or edge 181 of the rebound member 150*a* can be generally flush with the surface 110. For example, a distance between the edge 181 and the playing surface 110 can be less than about 0.2, 0.1, or 0.05 inch. The distance between the playing surface 110 and the edge 181 can be less than the thickness of the playing object. For example, the distance can be less than the height of the hockey puck. Advantageously, such embodiments are well suited to deflect hockey pucks and can prevent hockey pucks, hockey sticks, or other items from becoming lodged under the rebound member 150*a*. The rebound member 150*b* can be at similar orientations as the rebound member 150*a* to provide consistent rebounding characteristics from either side of the rebounding device 100. In other embodiments, the rebound members 150*a*, 150*b* can be at different orientations.

Figure 8:
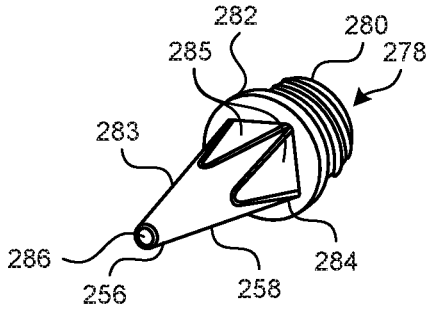
FIGS. 8 to 12 are views of anchors in accordance with embodiments of the technology.

FIG. 8 is a perspective view of an anchor 278 in accordance with one embodiment of the technology. The anchor 278 includes a mounting or proximal end 280 ("mounting end 280"), a seating portion 282, and an anchor portion 283. The mounting end 280 can include external threads configured to couple to a threaded component of the rebounding device. In some embodiments, the mounting end 280 can be coupled to an internally threaded hole of the frame 130. It will be appreciated that any of the exemplary anchors, spikes, or cleats disclosed herein could have threaded portions. The seating portion 282 can be a flange (e.g., an annular flange) extending outwardly beyond the mounting end 280 and/or the anchor portion 283. The seating portion 282 can rest upon a playing surface when the anchoring portion 283 extends into a support surface. The anchor portion 283 can be a spike, a cleat, or another anchoring feature. The anchor portion 283 can include a proximal anchor end 284, a main body 258, and a distal tip 256.

The distal tip 256 is generally conical or frustoconical for insertion into an ice surface. The anchor portion 283 shown in FIG. 8 also has flattened portions 285 that can be engaged by a tool in order to tighten or loosen the anchor 278 (e.g., spike or cleat replacement or repair). The anchor 278 also has a flat surface 286 (i.e., not sharp point) at the distal end. Such a surface, as well as rounded distal ends of the anchors, spikes, or cleats, may be beneficial for safety reasons because it is less likely that a person who comes into contact with such surfaces would suffer an injury. If the anchor 278 in FIG. 8 is used, the flat surface 286 can be generally parallel with the bottom face of the rebounding device in order to provide stability during installation. In some embodiments, pins, mechanical fasteners, nut assemblies, or the like can be used to permanently or detachably couple the anchor 278 to rebounding device 100.

Figure 9:
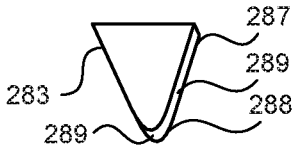
Figure 10:
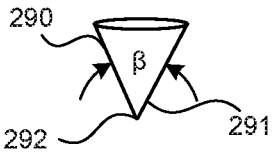
Figure 11:
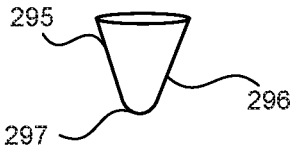

FIGS. 9-11 show various embodiments of distal portions of ice-penetrating anchors in accordance with embodiments of the technology. These distal portions can be incorporated into the anchor 140 of FIGS. 1-7, anchor 278 of FIG. 8, or into other anchors or coupling features disclosed herein. Referring now to FIG. 9, the anchor portion 283 includes the proximal portion 287, a distal portion 288, and a main body 289 extending between. The distal portion 288 can include a generally rounded tip 289 sufficiently sharp to pierce an ice surface but sufficiently rounded to avoid piercing a person's skin. The main body 289 can have a generally planar triangular shape.

FIG. 10 is an isometric view of an anchor portion 290 having a generally conical shape. The anchor portion 290 can have a distal end 291 that terminates in a relatively sharp tip 292, which defines an included angle in the range of about 5° to 45°, 10° to 25°, or 10° to 30°. The sharp tip 292 can have other configurations selected based on the desired seating force.

FIG. 11 is an isometric view of an anchor portion 295 with a distal portion 296 having a generally rounded tip 297. The radius of curvature of the tip 297 can be selected based on the desired force needed to drive the anchor portion 295 into a support surface.

Anchors can be of differing shapes and sizes, as shown in FIGS. 8 to 11, to adequately secure the rebounding devices disclosed herein to a support surface when the rebounding device is placed on the surface. It will be appreciated that the anchors can also be made of different materials, such as aluminum, steel, or the like. For example, the anchors can be made of stainless steel to avoid rust.

Figure 12:
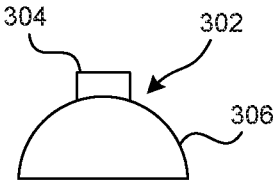

FIG. 12 is a side view of an anchor in the form of suction cup 302. The suction cup 302 can have a proximal portion 304 and a distal portion 306. The proximal portion 304 is configured to couple to a frame. The distal portion 306 can be in the form of a flexible cup suitable for coupling to a generally smooth surface, such as an ice surface, synthetic ice surface, or the like. The suction cup can be made, in whole or in part, of rubber, silicone, or other compliant materials.

It will also be appreciated that spike, cleats, and/or suction cups can be secured to the rebounder (e.g., coupled to the tubular frame) by thread engagements or other suitable means, such as, for example, by welding. According to some embodiments, the underside surface of the frame may have a plurality of untapped bores wherein nuts are aligned with the opening access of the bore and secured generally to the perimeter of the bore by welding, for example. The nuts do not need to be secured to the tubular frame. For example, the nuts could receive threaded spikes or cleats through the inside of the tubular frame.

Figure 14:
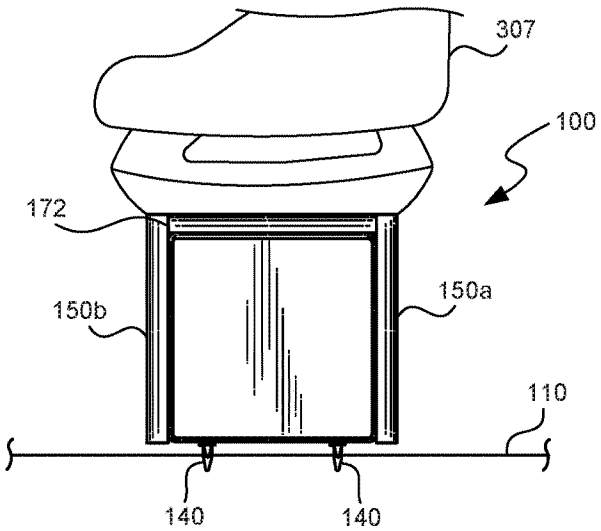
FIGS. 13 to 15 show a method of installing a rebounding device in accordance with some embodiments of the technology.
Figure 13:
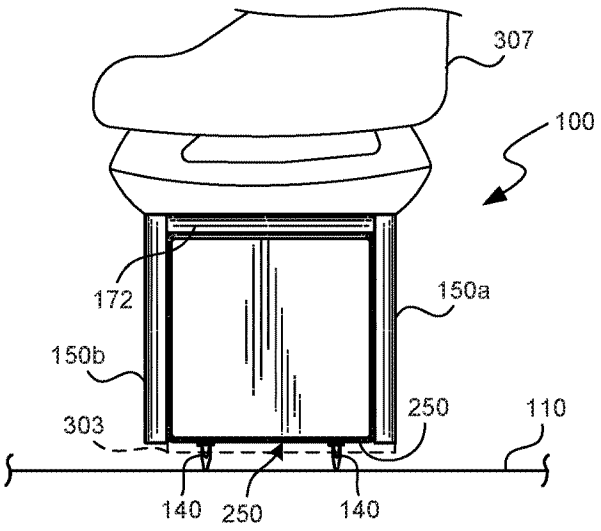
Figure 15:
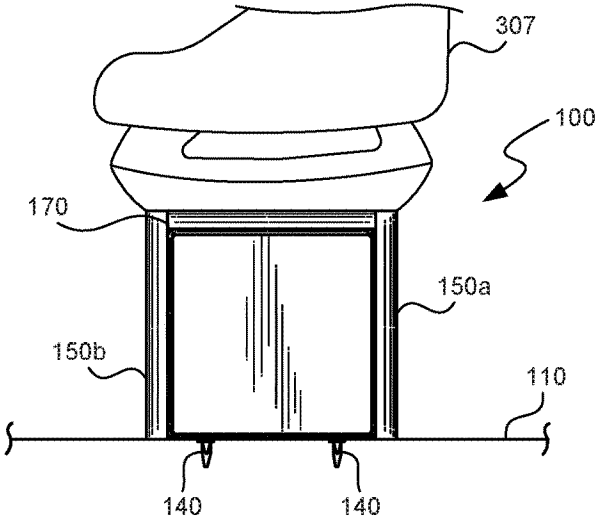

FIGS. 13 to 15 show one method of installing the rebounding device 100. Referring to FIG. 13, a user can place the anchors 140 on the surface 110. The anchors 140 can be arranged in a configuration that provides stability when the rebounding device 100 is placed on the surface 110 and can penetrate the ice surface and act to prevent the rebounding device 100 from being displaced from its location when a playing object impacts the rebounding members 150. The length of the anchors can be less than the thickness of the ice surface, which is typically between ¾-inch to 1½-inch thick. The anchors 140 can be, for example, 0.5 inch in length. It will be appreciated that the least number of anchors 140 as possible, while providing sufficient stability, can be used in order to cause the least amount of damage to the ice surface.

The user can place one or both skates 307 (one illustrated) on the stepping pad 172 and/or stepping pad 174. The user can apply a downward force to drive the anchors 140 into the surface 110. FIG. 14 shows the anchors 140 partially embedded in the underlying ice. The rebound members 150 are spaced apart from the surface 110.

FIG. 15 shows the rebound member 100 after the user has seated the anchors 140. The frame and/or rebound members 150*a*, 150*b* rest on the support surface 110. As shown in FIG. 15, the gaps (FIG. 14) between the rebound members 150*a*, 150*b* have been eliminated such that the bottoms of the members 150 are generally flush with the surface 110. Other techniques can be used to install rebounding devices.

The temperature of the frame 130 (FIG. 3) may be higher than that of the surface ice if, for example, the rebounding device has been kept in a warm car on the way to the hockey rink. Thus, according to some embodiments, an element in the form of a heat/thermal insulation barrier 303 (shown in phantom line in FIG. 13), which resists/blocks/reflects heat energy (either one or more of conduction, convection or radiation), could be secured to the underside 250 of the frame 130. The barrier 303 separates the underside surface 250 from the ice surface 110 and can act to resist/block/reflect heat energy from the frame 130, which would otherwise promote undesired melting of the ice surface. The barrier 303 also acts to protect the surface of the tubular frame from wet ice surfaces. The barrier 303 could be configured in multiple ways. For example, the barrier 303 could cover the entire underside surface of the tubular frame. As another example, the barrier 303 could be arranged in strips along the underside surface 250 and could be made of a wide variety of materials capable of providing a heat/thermal insulation barrier. The barrier 303 can be made of combinations of materials, for example, a Mylar sheet secured to the tubular frame with a thin rubber sheet secured to the opposite side of the Mylar sheet. In some embodiments, the barrier 303 is a friction pad that help inhibit movement.

According to some embodiments, the element 303 in the form of one or more spacers can be secured to the underside 250 in order to provide a separation between the underside of the frame and the ice surface so that the frame and ice surface do not contact each other. The spacers 303 can be made out of a variety of materials, such as rubber or plastic and can be positioned and configured in multiple ways, such as, for example, covering the entire underside surface of the frame, arranged as strips, or placed in the corners.

Figure 16:
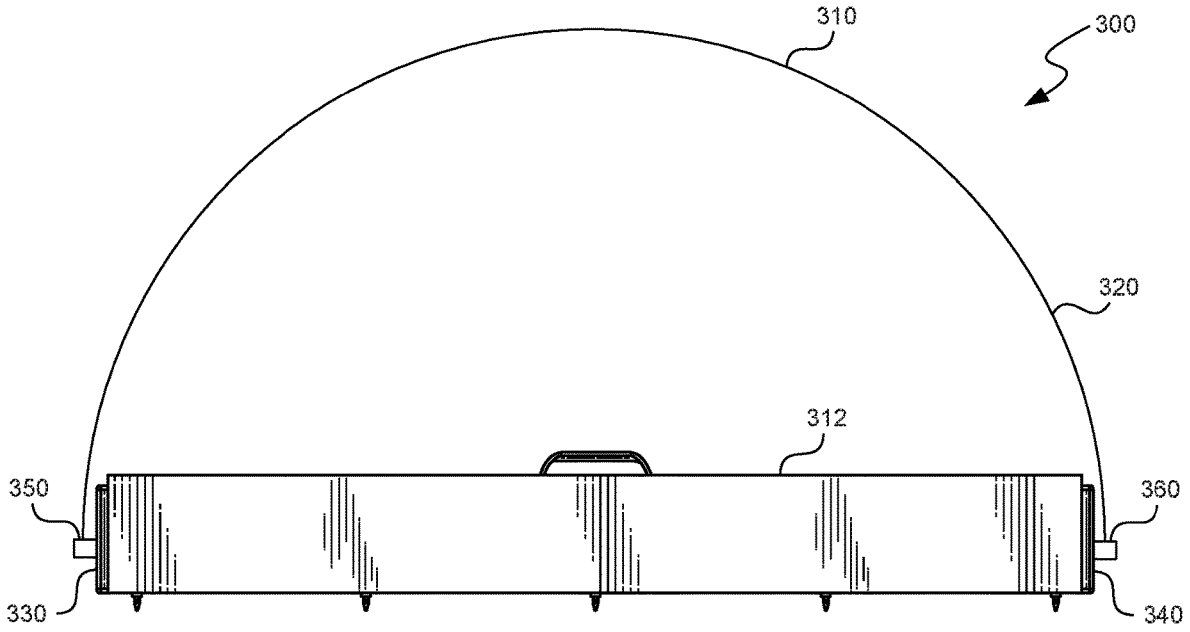
FIG. 16 is a side view of a training device in accordance with an embodiment of the technology.

FIG. 16 is a side view of a training device 300 in accordance with an embodiment of the technology. The training device 300 can include a strap system 310 and a rebounding device 312. The description of the rebounding devices discussed in connection with FIGS. 1-15 applies equally to the rebounding device 312, unless indicated otherwise.

The strap system 310 can be coupled to a frame, endcaps, or other components of the rebounding device 312. In some embodiments, the strap system 310 includes a shoulder strap 320 attachable to endcaps 330, 340 such that the rebounding device 312 can be suspended from a user's shoulder for convenient transport. The strap system 310 can include reusable couplers 350, 360 for allowing the user to remove the shoulder strap 320 from the rebounding device 312. In certain embodiments, the shoulder strap 320 can be separated from the rebounding device 312 so that the shoulder strap 320 does not interfere with use of the rebounding device. In other embodiments, the shoulder strap 320 can be permanently attached to the rebounding device 312 and can be made, in whole or in part, of fabric, leather, or other suitable material and can have a fixed or adjustable length. The shoulder strap 320 can include padding that increases carrying comfort.

Figure 17:
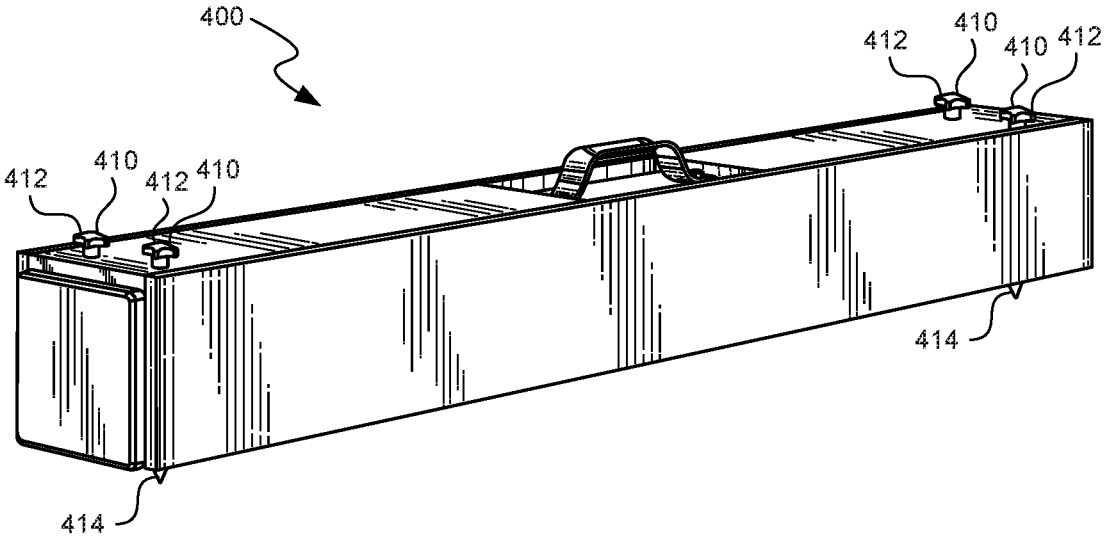
FIG. 17 is a perspective view of a rebounding device in accordance with an embodiment of the technology.
Figure 18:
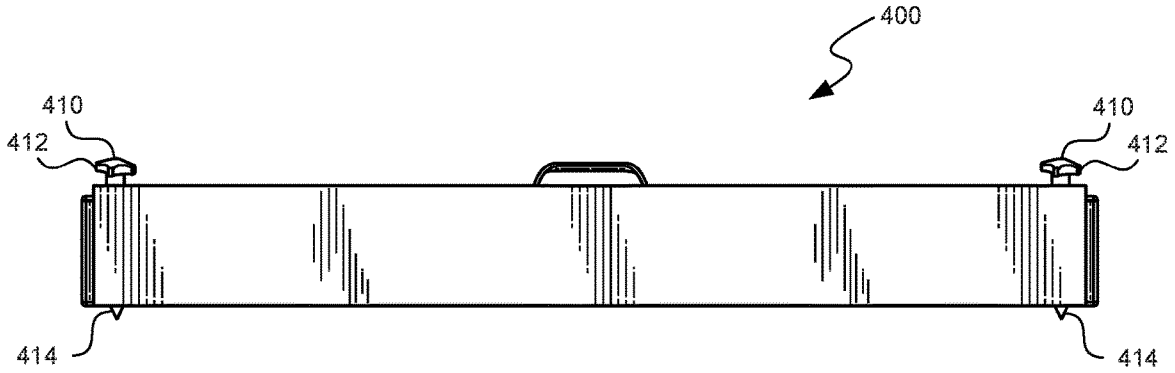
FIG. 18 is a side view of the rebounding device of FIG. 17.
Figure 19:
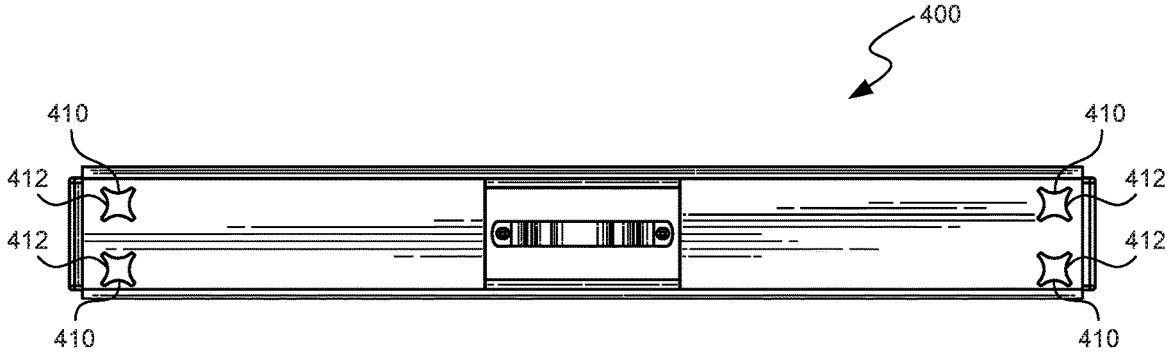
FIG. 19 is a top view of the rebounding device of FIG. 17.
Figure 20:
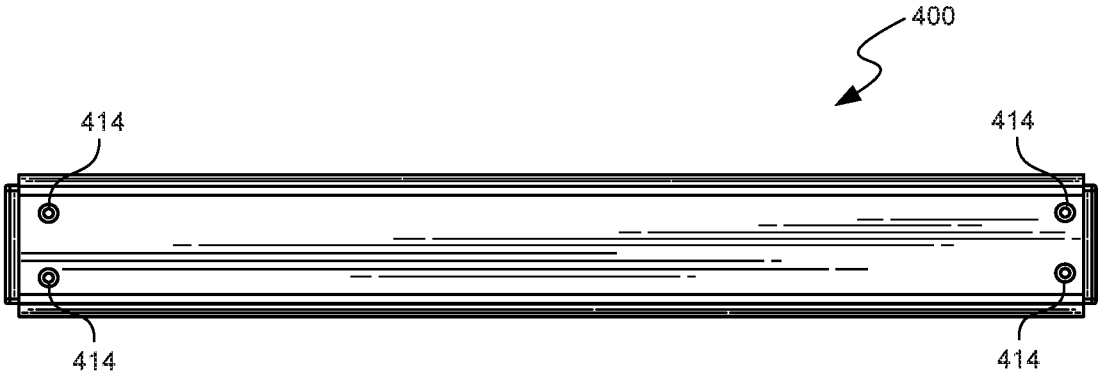
FIG. 20 is a bottom view of the rebounding device of FIG. 17.
Figure 21:
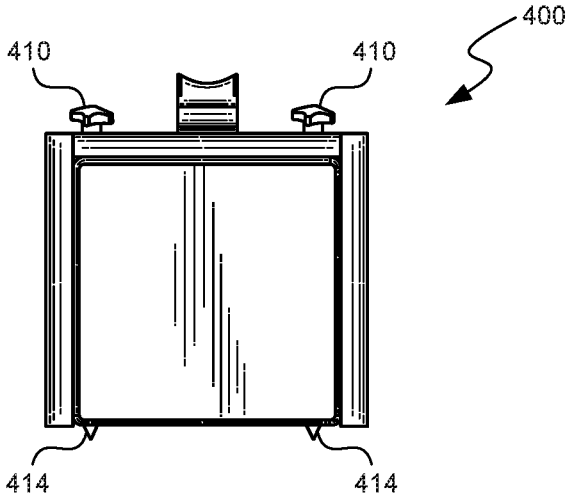
FIG. 21 is a front view of the rebounding device of FIG. 17.

FIGS. 17 to 21 show a rebounding device 400 in accordance with another embodiment. The rebounding device 400 is similar to the rebounding device 100 discussed in connection with FIGS. 1-7 and the rebounding device 312 discussed in connection with FIG. 16. Turning to FIG. 17, the rebounding device 400 includes a plurality of anchors 410 that can be moved into and out of a support surface. Each anchor 410 includes a handle or knob 412 ("handle 412") that can be manually used to deploy the anchor 410. In some embodiments, including illustrate embodiment, each anchor 410 can be individually rotated via the handle 412 to drive anchor tips 414 into a support surface. The handle 412 can then be used to separate the anchor from the support surface.

Figure 22A:
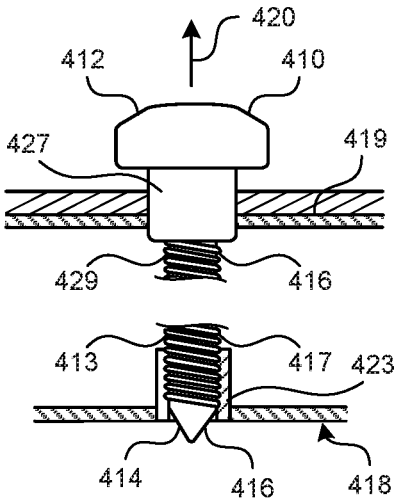
FIGS. 22A and 22B are partial cross-sectional views of a portion of the rebounding device of FIG. 17.
Figure 22B:
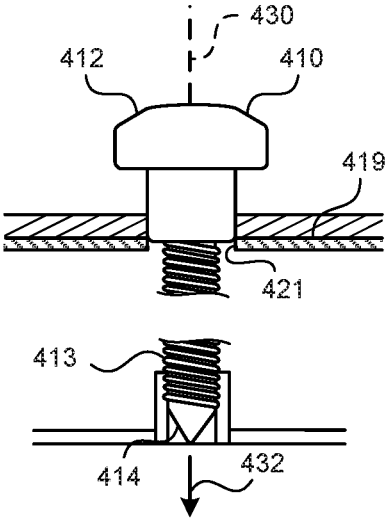

FIGS. 22A and 22B are partial cross-sectional views of the portion of the rebounding device 400. Referring now to FIG. 22A, the anchor 410 includes a spike or cleat 413 ("spike 413") that can be threaded to be driven into a surface. The spike 413 can include a proximal portion 416 and tip or tip portion 414 ("tip 414"). The handle 412 can be conveniently grasped by a user to rotate the spike 413 about axis 430 (FIG. 22B). The tip 414 can be configured to penetrate the surface as the spike 413 is driven downwardly (indicated by arrow 432 in FIG. 22B).

FIG. 22A shows the anchor 412 in a lowered or deployed position, and FIG. 22B shows the anchor 412 in a raised or undeployed position. According to some embodiments, the underside surface 418 of the tubular frame 419 may have a plurality of bores 421, the walls of which are tapped to receive anchors with threads 416. It will be appreciated that the bores do not need to extend through the width of the tubular frame, provided that the spike or cleat 413 can be adequately secured to the frame 419.

When the adjustment knob 412 is rotated, the threads 429 of the shaft 416 engage the threads 417 of a retaining post 423 secured to the tubular frame 419, thereby causing the spike or cleat 413 to be lowered or raised. In other embodiments, the spike or cleat 413 can be locked/unlocked via a release mechanism.

Figure 23A:
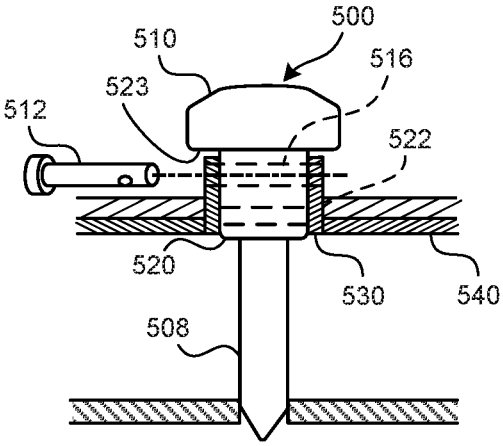
FIGS. 23A and 23B are partial cross-sectional views of a portion of a rebounding device in accordance with another embodiment.
Figure 23B:
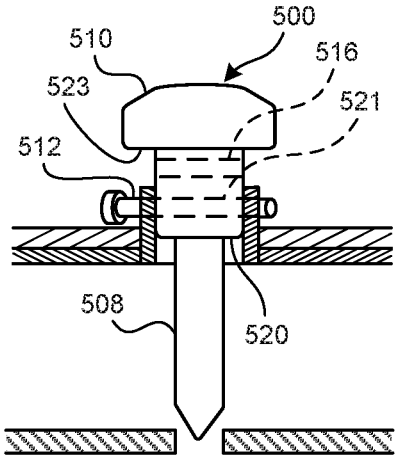

According to other embodiments, as shown in FIGS. 23A and 23B, the spike or cleats 508 ("spikes 508") are retractable by way of a locking mechanism. To lower the spikes 508, an adjustment knob 510 is lowered. A pin 512 is secured in an opening 516 (e.g., a hole) in a shaft 520, which extends through opening 522 in a retaining post 530 secured to a tubular frame 540, thereby locking the anchor 500 in the lowered position for engagement into the ice surface. To lock the cleat or spike 508 in the retracted position of FIG. 23B, the shaft is pulled up, and the pin 512 is inserted through holes in the retaining post and through the opening 521 (FIG. 23B) in the shaft 520. The shaft 520 could also have a ring or flange 523 around it that engages a spring. When the pin 512 is not inserted into openings 516 or 521 (FIG. 23B), the force of the spring against the ring 523 forces the cleats or spike into the retracted position. The adjustment knobs may be located within the frame rather than on top of the frame.

Figure 24:
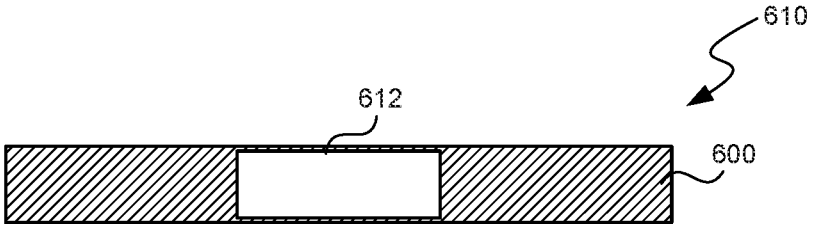
FIGS. 24 to 27 are front views of exemplary target markings on rebounding devices in accordance with some embodiments of the technology.
Figure 25:
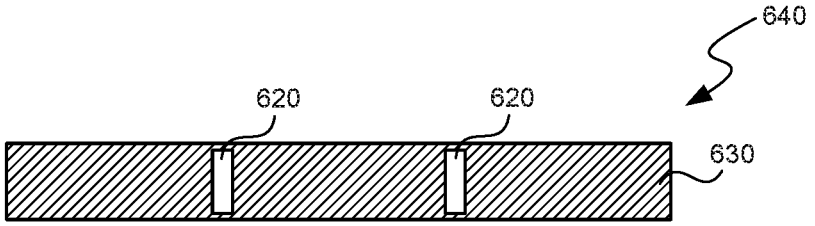
Figure 26:
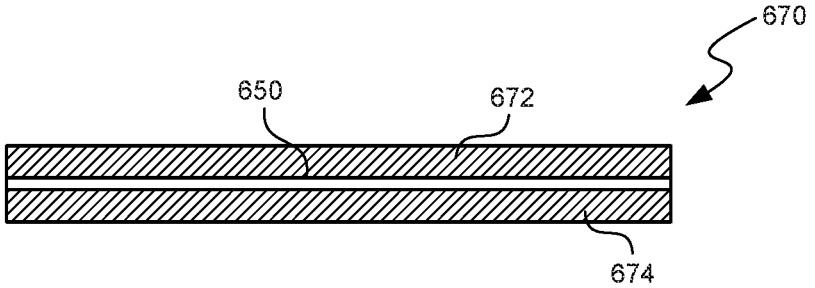
Figure 27:
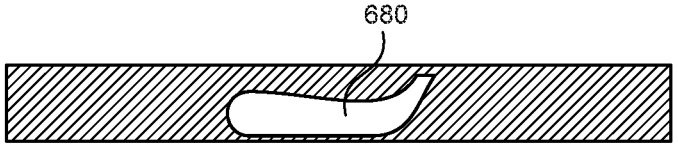

FIGS. 24 to 27 show faces of rebounding members including one or more markings to identify targets that players can use to practice passing, shooting, or the like. As shown in FIG. 24, a face 600 of a rebounding member 610 can include a center target 612, which extend along generally the length of a hockey stick blade. As another example, as shown in FIG. 25, elements or lines 620 could be oriented generally vertically to separate a face 630 of a rebounding member 640 into different segments. As another example, as shown in FIG. 26, a line 650 could be oriented generally horizontally to separate the face of the rebounding member 670 into an upper segment 672 and lower segment 674. It will be appreciated that the upper segment 672 can be used to practice flip or saucer passes, and the lower segment 674 could be used to practice passing along the ice. As another example, as shown in FIG. 27, a graphic of a hockey stick blade 680 can be drawn. The markings can be drawn, printed, adhered, or otherwise formed on or part of rebounding members. The targets can be incorporated into any of the rebounding devices disclosed herein.

Figure 28:
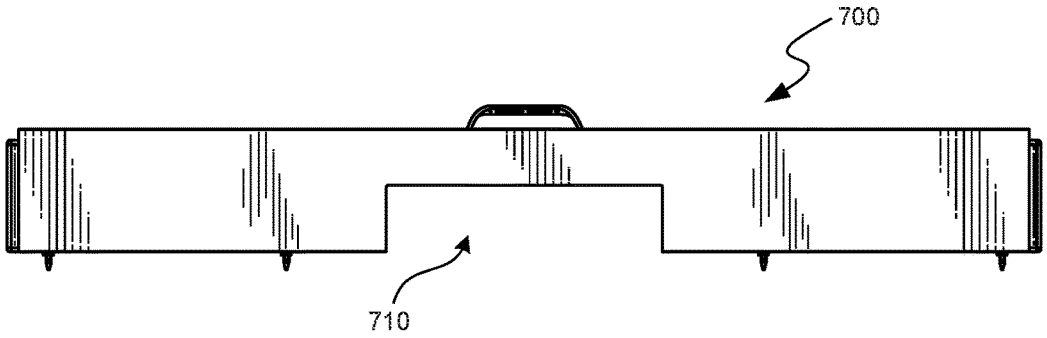
FIG. 28 is a side view of a rebounding device with a pass-through opening in accordance with some embodiments of the technology.

FIG. 28 is a side view of a rebounding device 700 that includes one or more pass-through features 710. The pass-through feature 710 can be a recess, a cutout, or a through hole suitable for practicing passing, shooting, or the like. In some embodiments, pass-through feature 710 can be a generally U-shaped through hole extending laterally across the rebounding device 700. When the rebounding 700 is anchored to a playing surface, hockey pucks, balls, or other playing objects can be moved along the plane surface and passed through the pass-through feature 710. In some embodiments, the rebounding device 700 includes multiple pass-through features 710 with the same or different configurations and/or dimensions. Pass-through features can be incorporated into other rebounding devices disclosed herein.

Figure 29:
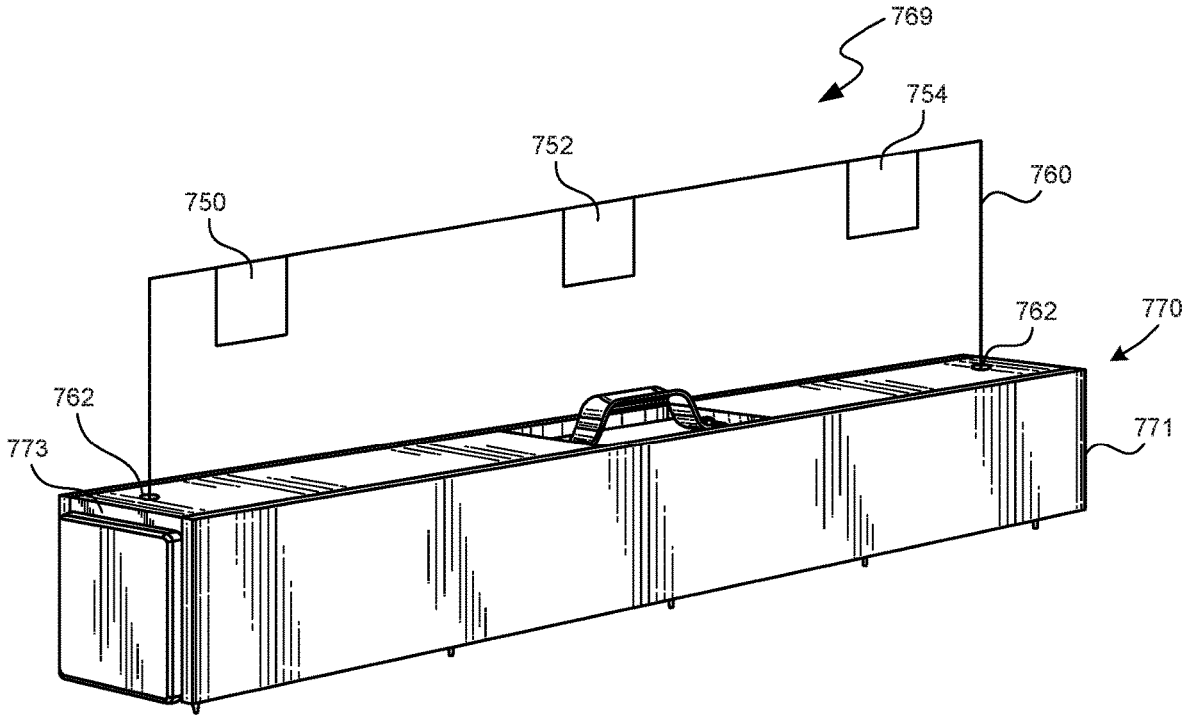
FIGS. 29 and 30 are perspective views of training devices with targets in accordance with some embodiments of the technology.

According to some embodiments, the training devices can further include shooting targets positioned above or to the sides of rebounding devices. For example, as shown in FIG. 29, a training device 769 has shooting targets 750, 752, 754 secured to a target frame or post 760, which can be inserted into receiving features in the form of, for example, openings or receptacles 762 ("openings 762") of a rebounding device 770. It will be appreciated that the target frame 760 could alternatively be permanently secured to the rebounding device 771 (by, for example, welding to the tubular frame 773) or removably secured to the rebounding device (by, for example, clips, nuts, magnets, etc.). In embodiments where the target frame or post 760 is removable, different shooting targets, such as those shown in FIGS. 24 to 27, could be used. The shooting targets (e.g. "targets") can be moveable such that when impacted by the shooting object, the targets move but the impact does not displace the rebounding device 771. According to some embodiments, the target frame or post 760 comprises of a flexible base, such as a spring base, configured to allow the target frame or post 760 to move if the target frame or post 760 is impacted by a playing object, or if fixed shooting targets are impacted by a playing object.

Figure 30:
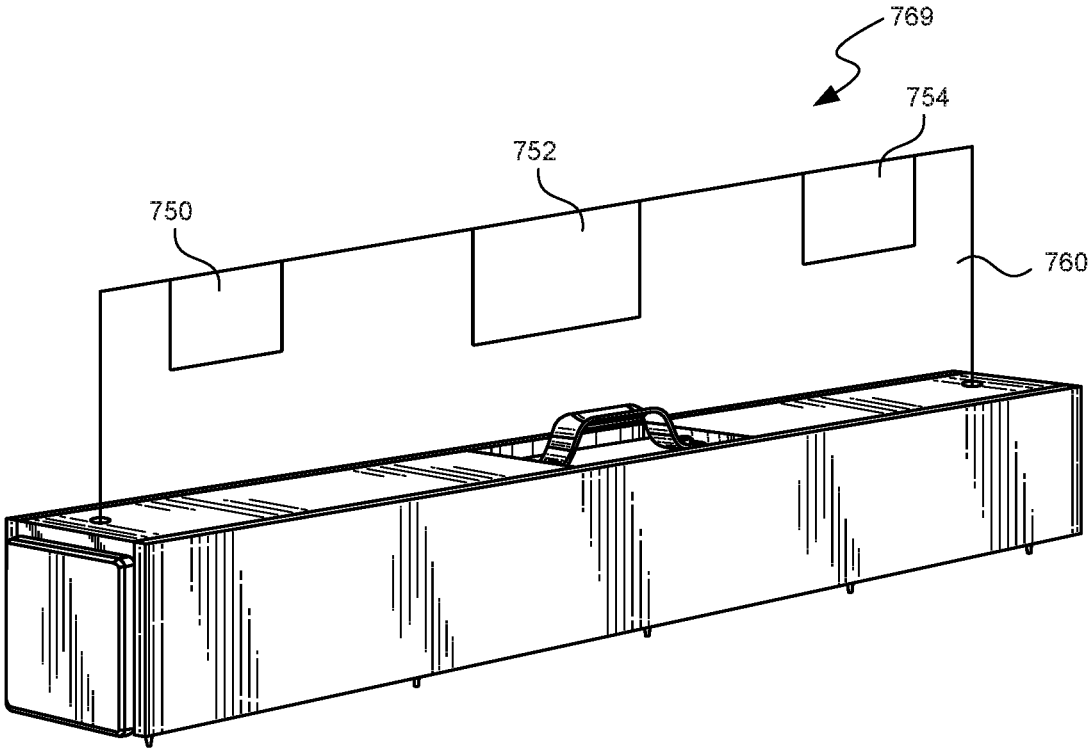

In some embodiments, the targets can have the same general shape and dimensions, as shown in FIG. 29. The targets can have different sizes to practice different skills. FIG. 30 shows the targets 750, 754 being smaller than a target 752. This allows a relatively large target to be positioned for passes above a central section of the rebounding device. The number, configuration, and dimensions of the targets can be selected based on the player's skill level, drills to be practiced, or the like. In some embodiments, a practice kit can include one or more rebounding devices, frames, and an array of targets. Targets can be mixed and matched and mounted to a selected frame 760 to practice various skills. During a single practice session, targets can be replaced and rearranged a number of times to practice different drills.

Figure 31:
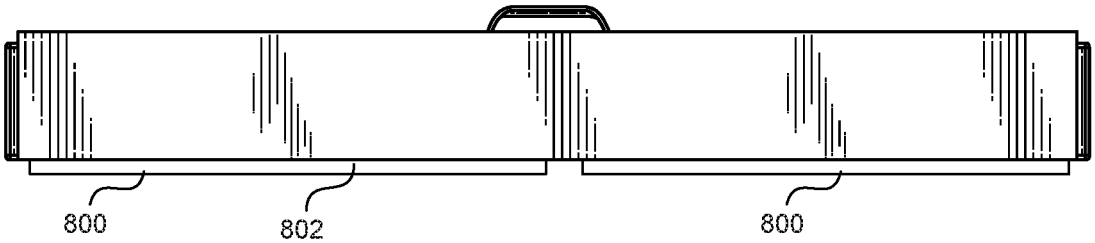
FIG. 31 is a side view of a rebounding device in accordance with another embodiment of the technology.
Figure 32:
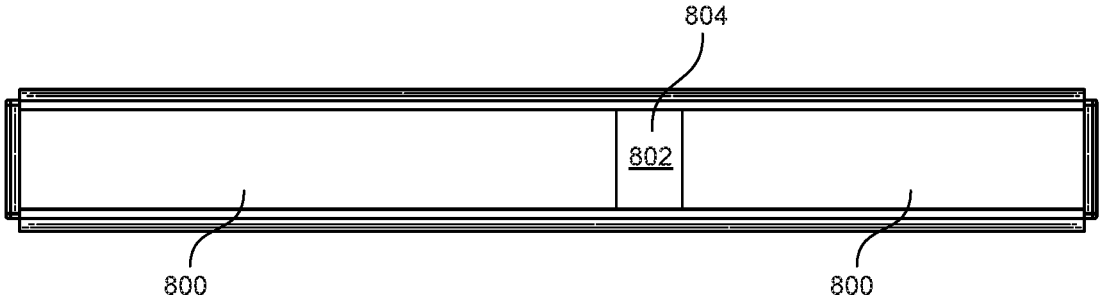
FIG. 32 is a bottom view of the rebounding device of FIG. 31.

According to some embodiments, the rebounding device could be configured for off-ice use. According to some embodiments, as shown in FIGS. 31 and 32, friction pads 800 could be secured (e.g., glued) to an underside surface 802 of frame 804 (FIG. 32) to provide a frictional force between friction pad and playing surface (e.g., a shooting pad surface, synthetic ice surface, floor, driveway, road, etc.). A wide variety of materials could be used for the friction pads. The friction pads can be formed of a material having a high coefficient of friction (e.g., rubber, friction tape, and anti-slip tape) for preventing or inhibiting movement of the rebounding device relative to the playing surface when a hockey puck strikes the rebounding member. In some embodiments, anchors (e.g., retractable or removable anchors) can be used with the pads 800. For example, the anchors can extend through openings in the pads for on-ice uses and can be retracted or removed for off-ice uses. The pads 800 can comprise a thermally-insulating material (e.g., rubber, silicon, etc.) for on-ice uses and can be mono or multilayer elements.

As another example, the tubular frame could be secured to a shooting pad using a nut and bolt, screw, etc. As another example, one or more suction cups could be used to secure the rebounding device. For example, one or more suction cups could be secured to the tubular frame by thread engagement (e.g., with the threads of a tapped bore of the tubular frame or with a nut on the inside of the tubular frame). The rebounding member can extend beyond the bottom side of the tubular frame to the extent that any means used to secure an off-ice embodiment of the rebounding device creates a gap between the bottom side of the tubular frame and the underlying surface.

Figure 33:
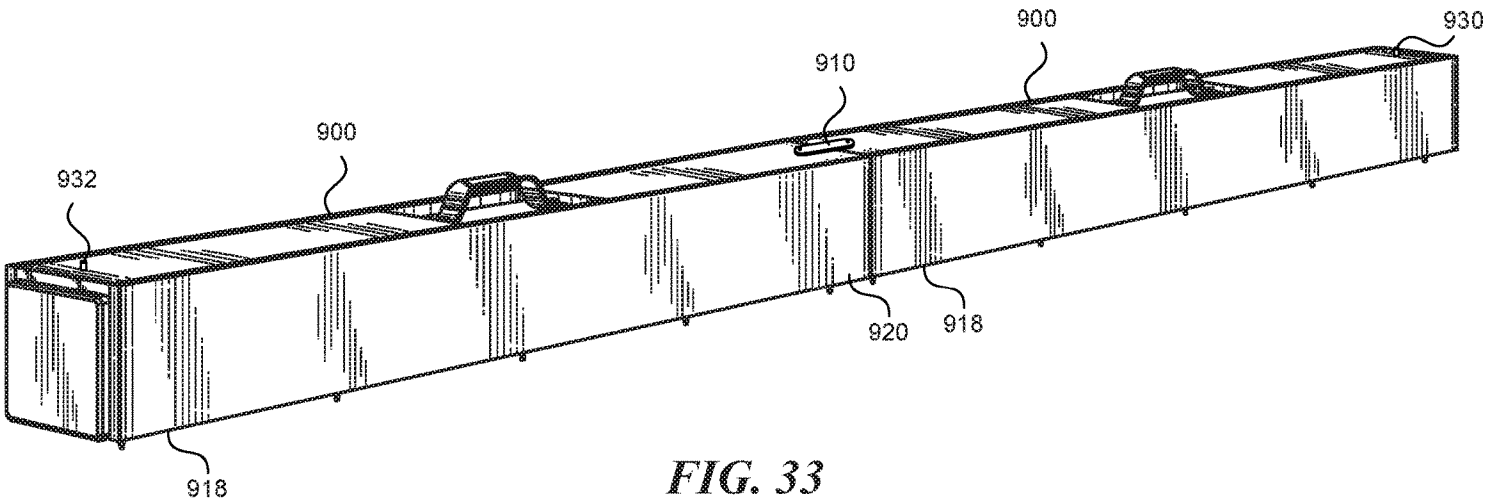
FIG. 33 is a perspective view of a training device in accordance with an embodiment of the technology.

FIG. 33 is an isometric view of a training device including multiple rebounding devices 900. The rebounding devices 900 can be coupled to one another to prevent separation during practice. In some embodiments, including the illustrated embodiment, a coupler 910 couples together adjacent ends 918, 920. Any number of couplers 910 can be used and can include one or more links, tethers, mechanical fasteners (e.g., nut and bolt assemblies, pin assemblies, etc.), or the like. The coupler 910 can disengage the rebound members to separate or otherwise move the rebound members. As shown in FIG. 33, the coupler 910 can hold the rebounding devices 900 in a generally linear arrangement. In other embodiments, the coupler 910 can be angled to hold the rebound devices 900 at other orientations, such as angled orientations.

Figure 35:
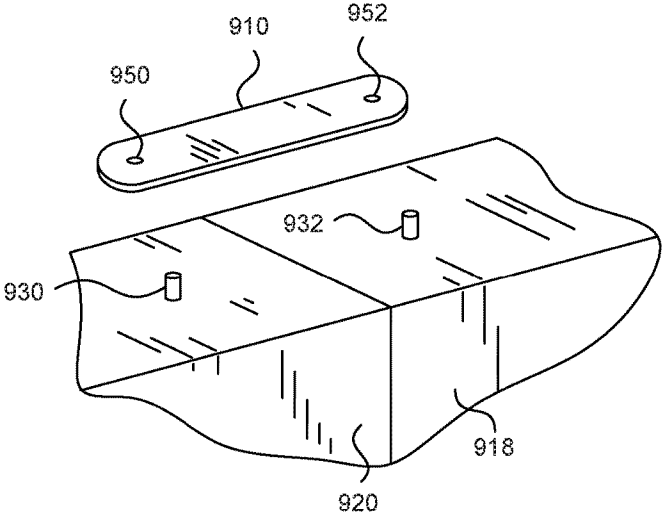
FIGS. 34 and 35 are detailed views of a coupler in accordance with an embodiment of the technology.
Figure 34:
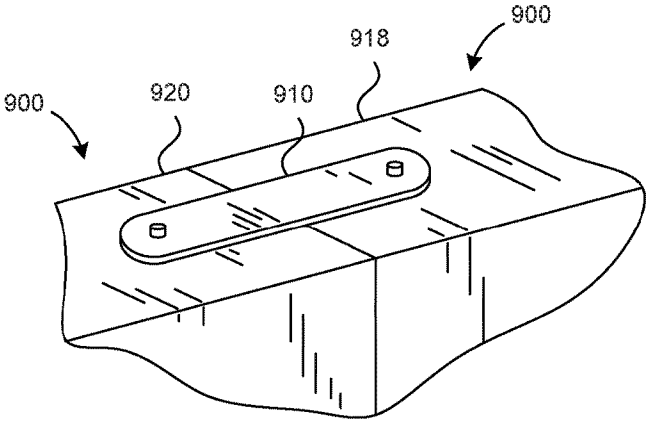

FIGS. 34 and 35 are detailed views of the coupler 910. FIG. 34 shows the coupler 910 coupled to the ends 920, 918. FIG. 35 shows the coupler 910 separated from pins 930, 932. The coupler 910 can include openings 950, 952 configured to receive the pins 930, 932, respectively.

In use, each rebound devices 900 can be placed on the ice and the ends 920, 918 can be mated. For example, endcaps at the ends 920, 918 can contact one another. A user can then press down on the rebound devices 900 to secure them to the support surface. The coupler 910 can be mounted on the rebounding devices 900, thereby coupling together the rebounding devices.

Figure 36:
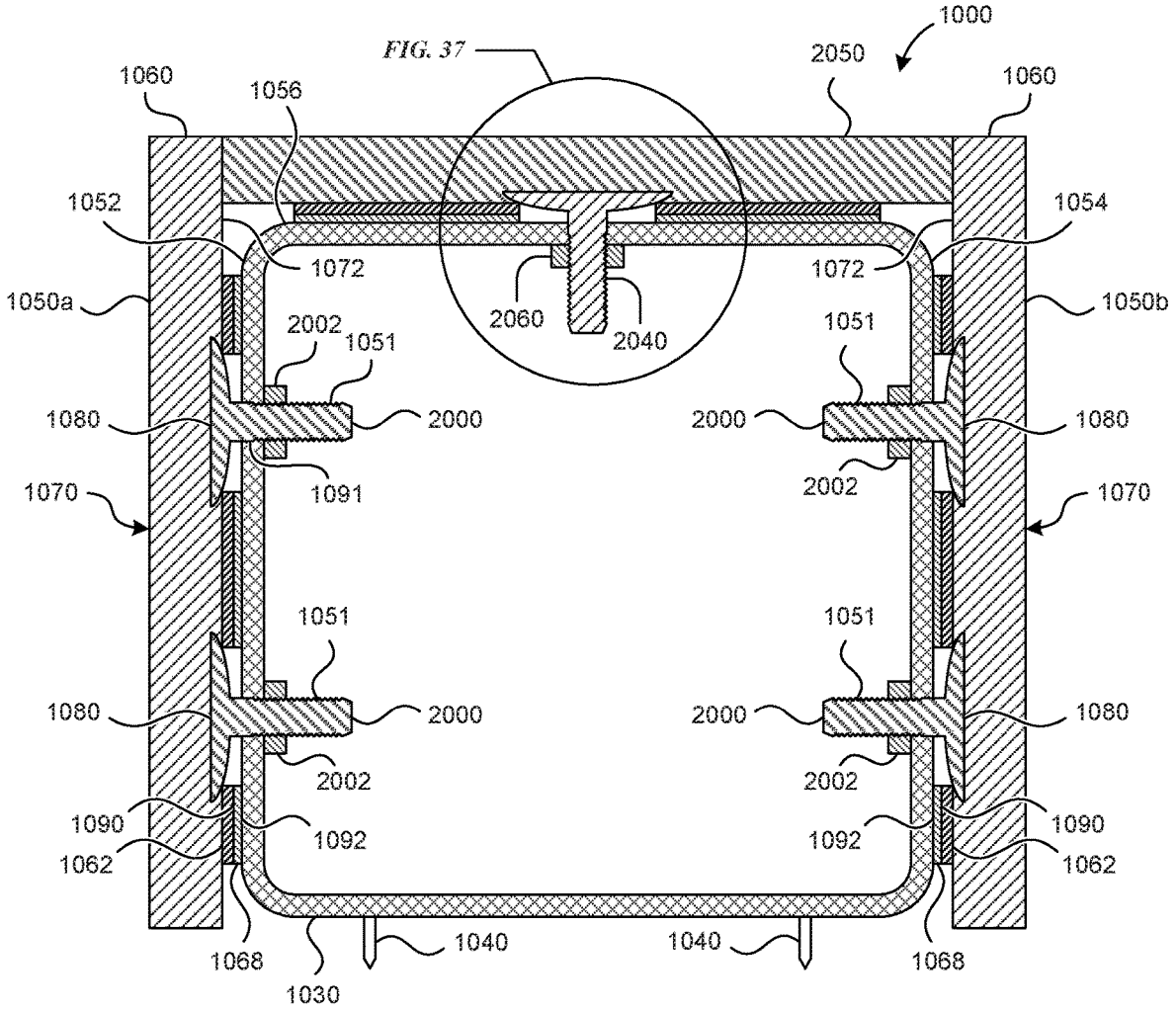
FIG. 36 is a cross-sectional view of a rebounding device in accordance with one embodiment of the technology.

FIG. 36 is a cross-sectional view of a rebounding device 1000 in accordance with one embodiment of the technology. The rebounding device 1000 can include a frame 1030, anchors 1040, and rebound members 1050*a*, 1050*b* (collectively "rebound members 1050"). Each rebound member 1050*a*, 1050*b* is removably coupled to the frame 1030 by one or more fasteners 1051 and can be replaced with another rebound member. In a practice session, the rebound members 1050*a*, 1050*b* can be replaced any number of times without damaging the frame 1030 or other components. The rebounding device 1000 can also be reconfigured between practice sessions. The description of one of the rebound members 1050 applies equally to the other unless indicated otherwise.

The rebound members 1050*a*, 1050*b* can have generally similar characteristics for practicing the same drill on opposite sides of the rebounding device 1000 or can have different characteristics for practicing different drills on opposite sides of the rebounding device 1000. For example, the rebound member 1050*a* can be a rigid, noncompliant panel such that rebounded objects travel at high speeds (i.e., the rebounded object leaves the rebounding member 1050*a* at a high speed), whereas the rebound member 1050*b* can be compliant for absorbing energy such that rebounded objects travel at low speeds. Additionally, the rebound members can have targets or other features. In some embodiments, the rebound member 1050*a* can include targets in a first pattern, and the rebound member 1050*b* can have targets in a second pattern that is different from the first pattern. A player can use the different sets of targets to practice a variety of skills.

The rebound members 1050*a*, 1050*b* can be coupled to sides or walls 1052, 1054 of the frame 1030. In multiplayer embodiments, each rebound member 1050 can include a deflecting or outer layer 1060 ("deflecting layer 1060"), an intermediate layer 1062, and a base layer 1068. The deflecting layer 1060 can have an outer surface 1070 suitable for being struck by objects. Additional layers of the deflecting layer 1060 can be made of other materials, such as compliant energy-absorbing materials, elastic materials, or the like. The intermediate layer 1062 can be a metal layer, a plastic layer, or other type of layer coupled to or integrated with a surface 1072 of the deflecting layer 1060.

The fasteners 1051 can have heads 1080 captively held between the deflecting layer 1060 and the intermediate layer 1062. The intermediate layer 1062 can be adhered, bonded, or otherwise coupled to the surface 1072 to securely hold the head 1080 within a recess or other feature of the deflecting layer 1060 suitable for receiving at least a portion of the head 1080. The heads 1080 can be located at other locations selected based on the configuration of the rebound members 1050.

The base layer 1068 can be coupled to the intermediate layer 1062 via one or more adhesives (e.g., glue, pressure sensitive adhesive, etc.), coupling features, or the like. The base layer 1068 can be made, in whole or in part, of rubber, silicon, or another material capable of reducing or limiting noise, vibrations, or the like. In some embodiments, the base layer 1068 includes a first face 1090 permanently adhered to the intermediate layer 1062 and a second face 1092 that lays flat on the frame 1030. In some embodiments, the base layer 1068 can be integrated with the tubular frame 1030. The configuration and characteristics of the base layer 1068 can be selected based on the desired engagement between components and overall energy-absorbing characteristics, wear characteristics, acoustic characteristics, or the like. In monolayer embodiments, each rebound member 1050 can be made, in whole or in part, of rubber, silicon, polyurethane, combinations thereof, or the like. For example, each rebound member 1050 can be a single layer of rubber.

The frame 1030 can have holes 1091 (one identified) for receiving the fasteners 1051. The number, position, and spacing of the holes 1091 can be selected based on the desired mounting arrangement of the panels 1050. In some embodiments, fasteners 1051 can be positioned in vertically-spaced-apart holes 1091 to hold upper and lower portions of the panel 1050 against the frame 1030. In other embodiments, fasteners 1051 can extend through a hole 1091 located in the middle of the side 1052 of the frame 1030.

Each fastener 1051 can include a bolt 2000 and a nut 2002, which can be rotated to pull the head 1080 of the bolt 2000 toward the tubular frame 1030. A user can torque the nut 2002 to apply desired compressive stresses to portions of the rebounding panel 1050 between the head 1080 and the tubular frame 1030. The configuration, features, and positions of the fasteners 1051 can be selected based on the desired mounting arrangement of the panels 1050. To provide convenient access for rotating the nuts 2002, the fasteners 1051 can be located near open ends of the tubular frame 1030. In quick-release embodiments, the fasteners 1051 can include snaps, pin assemblies, or other coupling features for removing the fasteners 1051.

The holes 1091 (one identified) can be configured to inhibit or prevent rotation of the fasteners 1051 by receiving a non-circular (e.g., substantially polygonal) and complementary-shaped bolt 2000. For example, each hole 1091 can have a generally square shape that receives a portion of the bolt 2000 with a corresponding square shape. As such, the bolt 2000 can remain rotationally fixed to the tubular frame 1030. Additionally or alternatively, the bolt 2000 can be rotationally fixed to the panel 1050 by its head 1080. For example, the head 1080 can have a polygonal shape and can be received with a corresponding complementary-shaped polygonal recess in the deflecting layer 1060. In some embodiments, the bolt head 1080 can be adhered (e.g., glued), fused, and/or bonded to the deflecting layer 1060 or other layer of the rebound member 1050.

The region of the deflecting layer 1060 between the fasteners 1000 and the external surface 1070 can be selected to ensure that the fastener 1051 does not alter the geometry of the surface 1070. In some embodiments, the head 1080 has a flat surface facing the deflecting panel 1060 such that the bolt 2000 does not substantially change the geometry of the exterior face 1070 of the rebound member 1050. Accordingly, the outer face 1070 can remain substantially flat irrespective of the compressive forces applied by the fastener 1051 to the rebound member 1050. Stiffeners (e.g., metal plates), stiffening rods, or other features can be coupled to or integrated with the rebound member 1050. The number, positions, configuration, and dimensions of the stiffeners can be selected to achieve the desired characteristics of the rebound member 1050.

Figure 37:
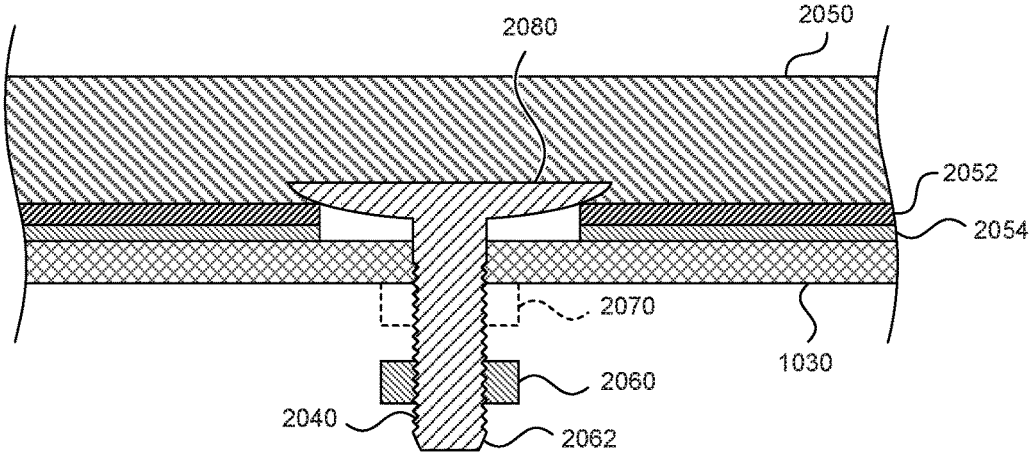
FIG. 37 is a detailed view of a portion of the rebounding device of FIG. 36.

FIG. 37 is a detailed view of a portion of the rebounding device of FIG. 36. A fastener 2040 can couple an upper stepping member or pad 2050 to the frame 1030. An intermediate layer 2052 and a base layer 2054 can be located between the pad 2050 and an upper portion of the frame 1030. The fastener 2040 is ready to pull the pad 2050 toward or against the frame 1030 and can include a nut 2060 and a bolt 2062. The nut 2060 can be rotated relative to the bolt 2062 to move from the illustrated position to an installed position 2070 (illustrated in phantom line in FIG. 37). The intermediate layer 2052 can be coupled (e.g., adhered, glued, bonded, fused, etc.) to the pad 2050. When the head 2080 and nut 2060 apply compressive stress to the intermediate layer 2052, the pad 2050 can be held securely to the frame 1030.

With reference now to FIGS. 36 and 37, the nuts 2002, 2060 can be torqued to achieve desired compressive stresses for securely mounting members to the frame 1030. If suitable contact is not made between members and the frame, the user can torque the nuts to increase the compressive forces. User can manually remove the nuts from the bolts to, for example, replace the panels, inspect the panels, or otherwise reconfigure the rebounding device 1000.

Figure 38:
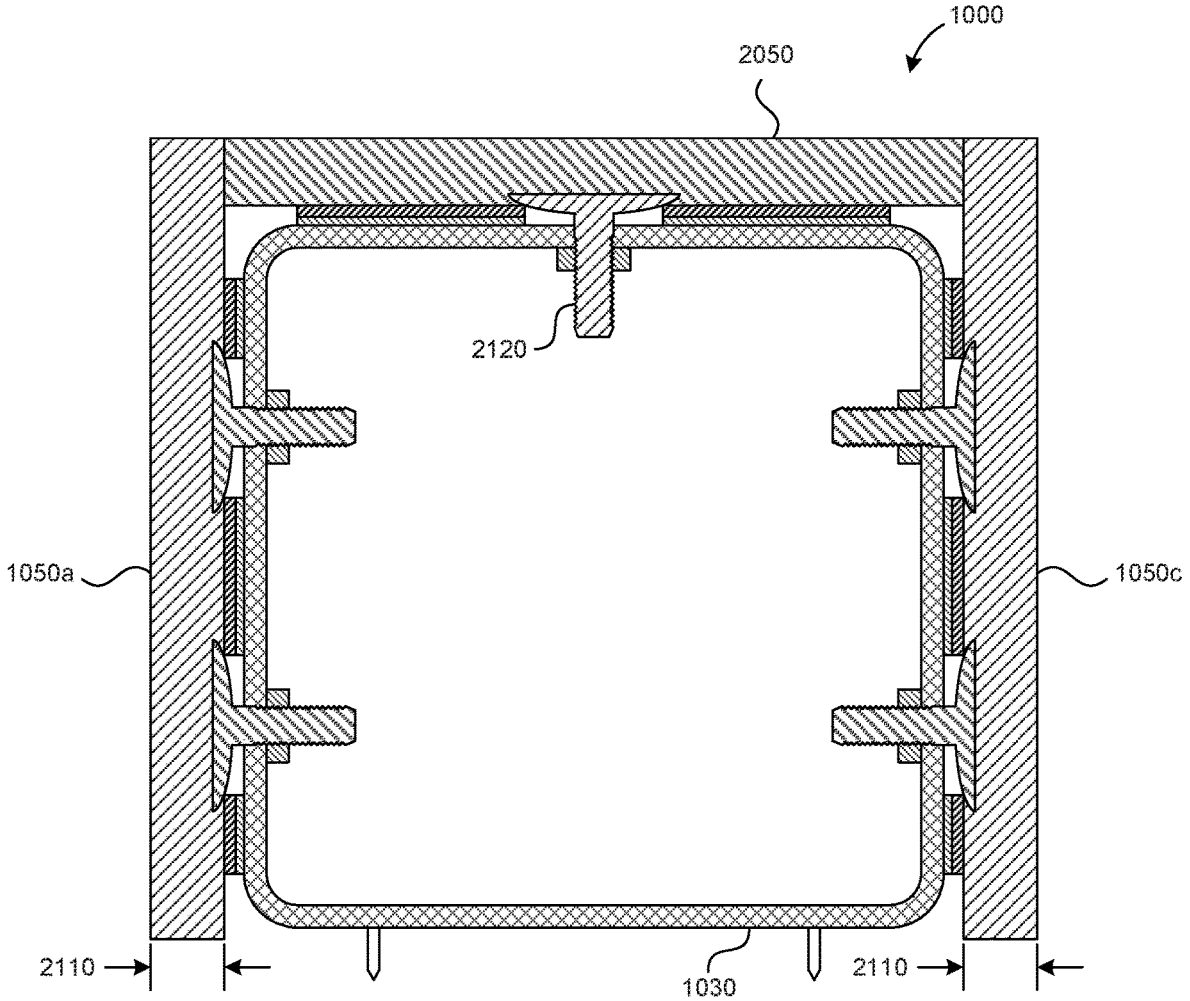
FIG. 38 is a cross-sectional view of a rebounding device with rebounding panels in accordance with one embodiment of the technology.

FIG. 38 is a cross-sectional view of the rebounding device 1000 with a rebounding panel 1050*c* for absorbing energy from objects travelling at high speeds. In one installation, the panel 1050*c* is made of a highly compliant material, such as silicon, while the panel 1050*a* can be made of a relative hard material, such as urethane. The panel 1050*c* can be quickly and conveniently replaced with another panel, such as the panel 1050*b* discussed in connection with FIG. 36. The replaceable panels 1050 allow a user to conveniently reconfigure the rebounding device to practice a wide range of skills without altering the frame 1030.

Figure 39:
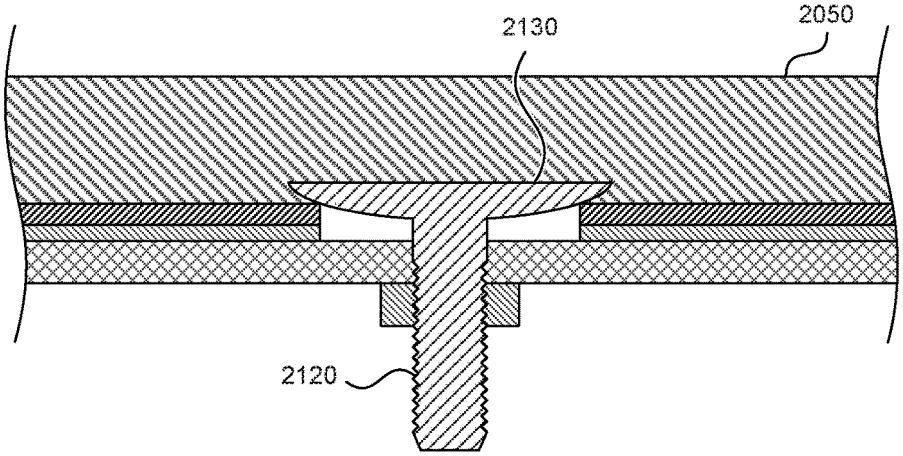
FIG. 39 is a cross-sectional view of a portion of a rebounding device in accordance with another embodiment of the technology.

The fasteners disclosed herein can be coupled or connected to rebound members in different ways. FIG. 39 is a cross-sectional view of a fastener 2120 with a fastener head 2130 partially or completely embedded in the pad 2050. The fasteners 1051 discussed in connection with FIG. 36 can also be embedded in the panels 1050. Other techniques can be used to couple the fasteners disclosed herein to the panels. In yet other embodiments, the panels can include integrated fasteners for coupling to frames or another component. The fasteners, rebound members, frames, and other components discussed in connection with FIGS. 36-39 can be incorporated into other rebound devices disclosed herein.

Figure 40:
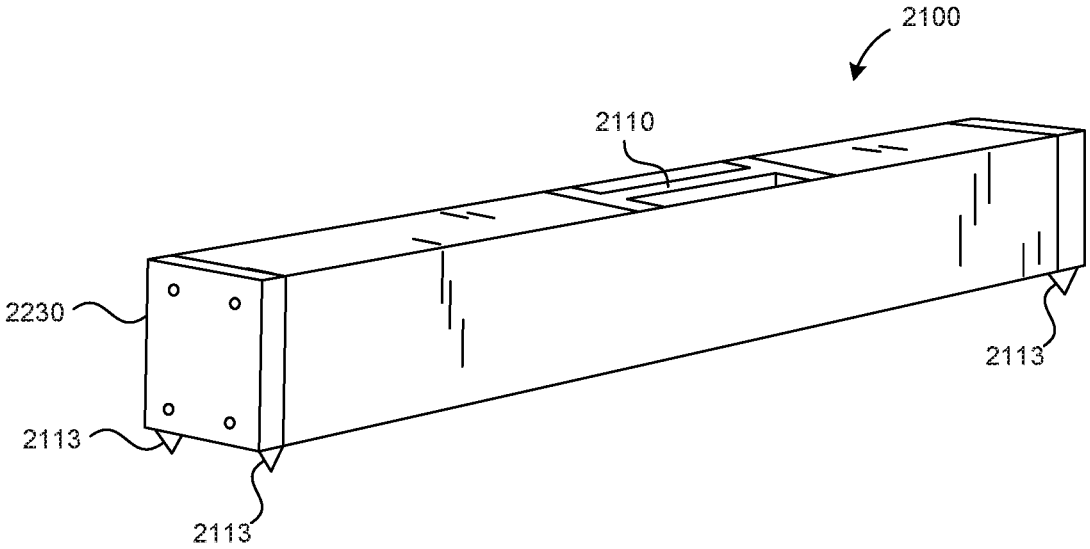
FIG. 40 is an isometric view of a rebounding device in accordance with one embodiment of the technology.
Figure 41:
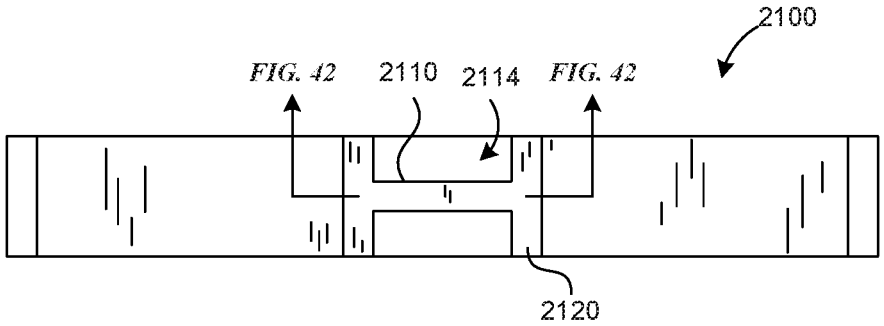
FIG. 41 is a plan view of the rebounding device of FIG. 40.

FIG. 40 is an isometric view of a rebounding device 2100 in accordance with one embodiment of the technology. FIG. 41 is a plan view of the rebounding device 2100 of FIG. 40. Referring now to FIGS. 40 and 41, the rebounding device 2100 can include a recessed handle 2110. A user's fingers can be inserted into a recessed region or opening 2114 to grip the handle 2110. The handle 2110 can be part of the frame or another component of the rebounding device 2100 and can be made, in whole or in part, of metal, plastic, cable, rope, or another suitable material. Anchors 2113 can be coupled to a tubular frame, endcaps (e.g., caps, plates, covers, etc.), or other components of the rebounding device 2100.

Figure 42:
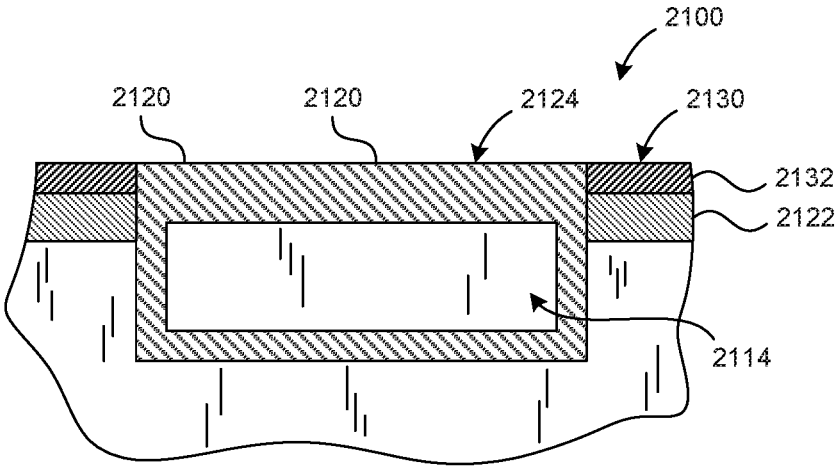
FIG. 42 is a cross-sectional view of the rebounding device taken along line 42-42 of FIG. 41.

FIG. 42 is a cross-sectional view of the rebounding device 2100 taken along line 42-42 of FIG. 41 in accordance with one embodiment of the technology. The handle 2110 can be part of a handle assembly 2120 coupled to a frame 2122. A top surface 2124 of the handle 2110 can be substantially flush or recessed with respect to a surface 2130 of a stepping member or pad 2132.

The handle 2110 can be integrated with or coupled to the tubular frame 2122. In some embodiments, the handle 2100 is a flexible handle coupled to a frame by one or more fasteners (e.g., screws), adhesive, or other coupling means, such as retainers. The flexible handle 2100 can be a strap with end sections that extend through openings (e.g., slots) in the tubular frame 2122. Each portion of the end section inside of the tubular frame 2122 can be permanently or removably coupled to a retainer, which can be larger than the slot. The retainers can engage the inside surface of the tubular frame 2122 when the strap is lifted or pulled. In other embodiments, the retainers can be coupled to the tubular frame 2122 via adhesive, welds, fasteners, etc. The configurations of the retainers, fasteners, and handles can be selected based on the characteristics and configuration of the rebounding device 2100.

Figure 43:
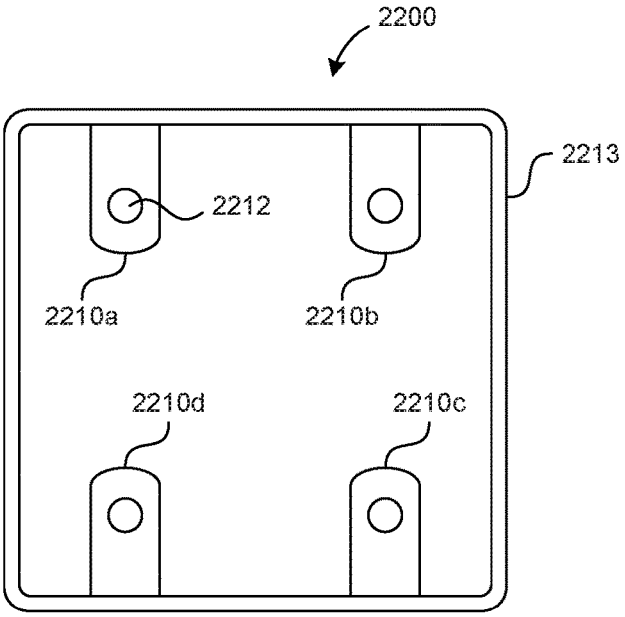
FIG. 43 is a front view of a tubular frame in accordance with one embodiment of the technology.

FIG. 43 is a front view of a tubular frame 2200 for rebounding devices in accordance with one embodiment of the technology. The tubular frame 2200 includes mounting tabs 2210*a*, 2210*b*, 2210*c*, 2210*d* (collectively "mounting tabs 2210") to which an endcap can be coupled. The description of one mounting tab applies equally to the others unless indicated otherwise. The mounting tab 2210*a* includes an opening 2212 configured to receive a fastener and can be coupled to or integrated with body 2213 of the tubular frame 2200. The number, configuration, and features of the mounting tabs 2210 can be selected based on the configuration of the endcap, such as the endcap discussed in connection with FIG. 44, or other component coupled to the frame 2200.

Figure 44:
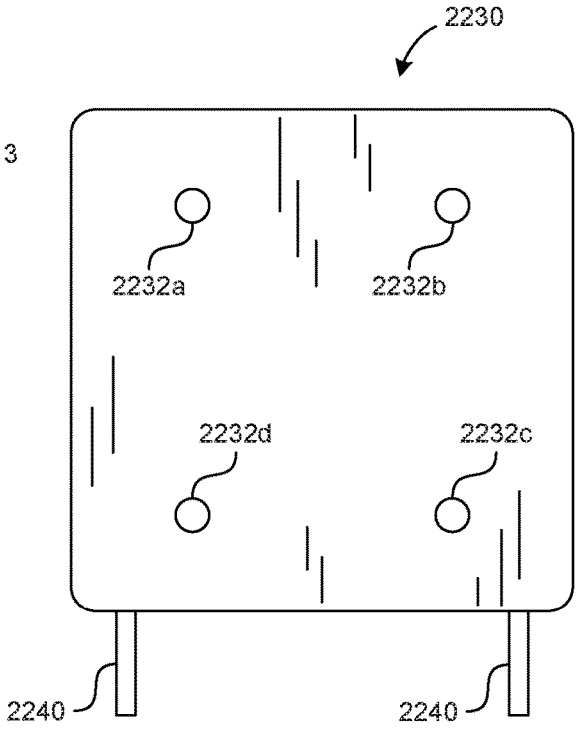
FIG. 44 is a front view of an endcap coupleable to a tubular frame in accordance with one embodiment of the technology.
Figure 45:
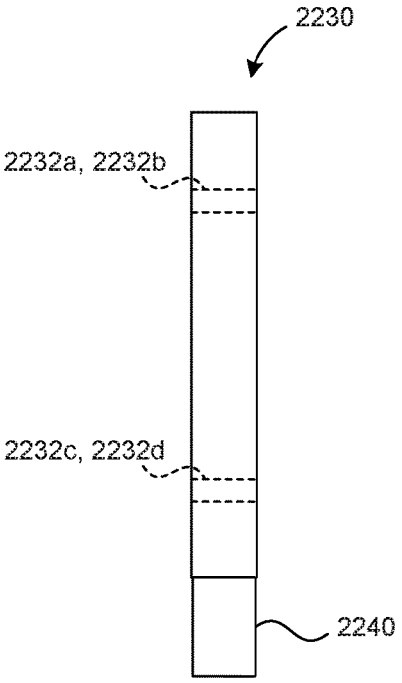
FIG. 45 is a side view of the endcap of FIG. 44.

FIG. 44 is a front view of an endcap 2230 in accordance with one embodiment of the technology. FIG. 45 is a side view of the endcap 2230. FIG. 40 shows two endcaps 2230 coupled to a frame of the rebounding member 2100, and other rebounding members disclosed herein can have the endcaps 2230. Referring now to FIG. 44, the endcap 2230 can include openings 2232*a*, 2232*b*, 2232*c*, 2232*d* that can be aligned with the respective openings in the mounting tabs 2210*a*, 2210*b*, 2210*c*, 2210*d* of FIG. 43. Fasteners can be inserted into the openings to detachably couple the endcap 2230 to the tubular frame. The pattern, dimensions, and number of openings can be selected based on the configuration of the frame and mounting means.

The endcap 2230 can also include optional anchors 2240. A user can remove the endcaps 2230 so that there are no anchors on the rebounding device, thereby allowing the rebounding device to be used for off-ice purposes. Additionally or alternatively, the endcap 2230 can include suction cups or other coupling features. Also, if an anchor or other coupling feature breaks, the damaged endcap 2230 can be replaced.

Figure 46:
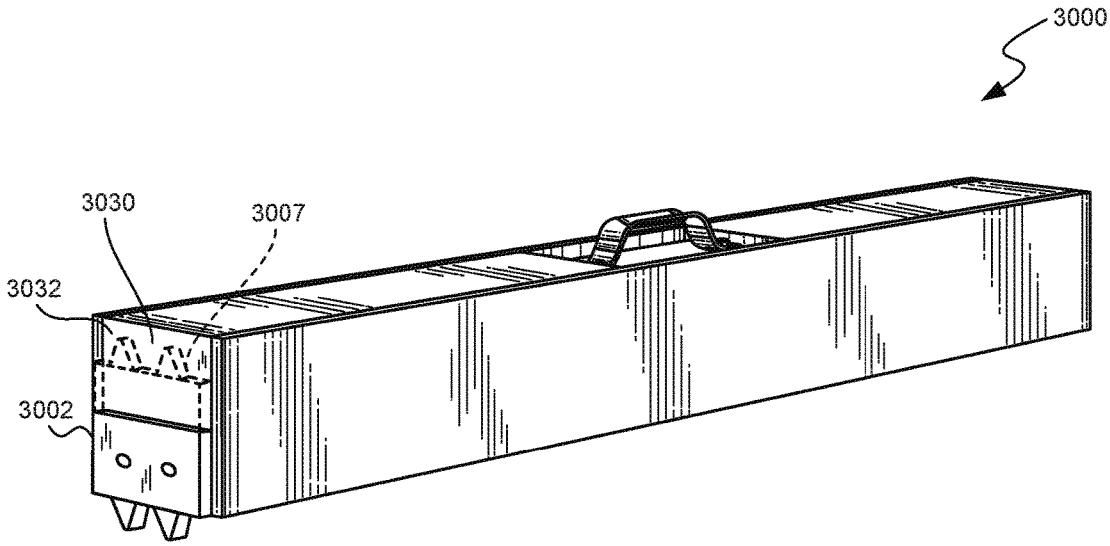
FIG. 46 is an isometric view of a rebounding device with reversible endcap members in accordance with one embodiment of the technology.
Figure 47:
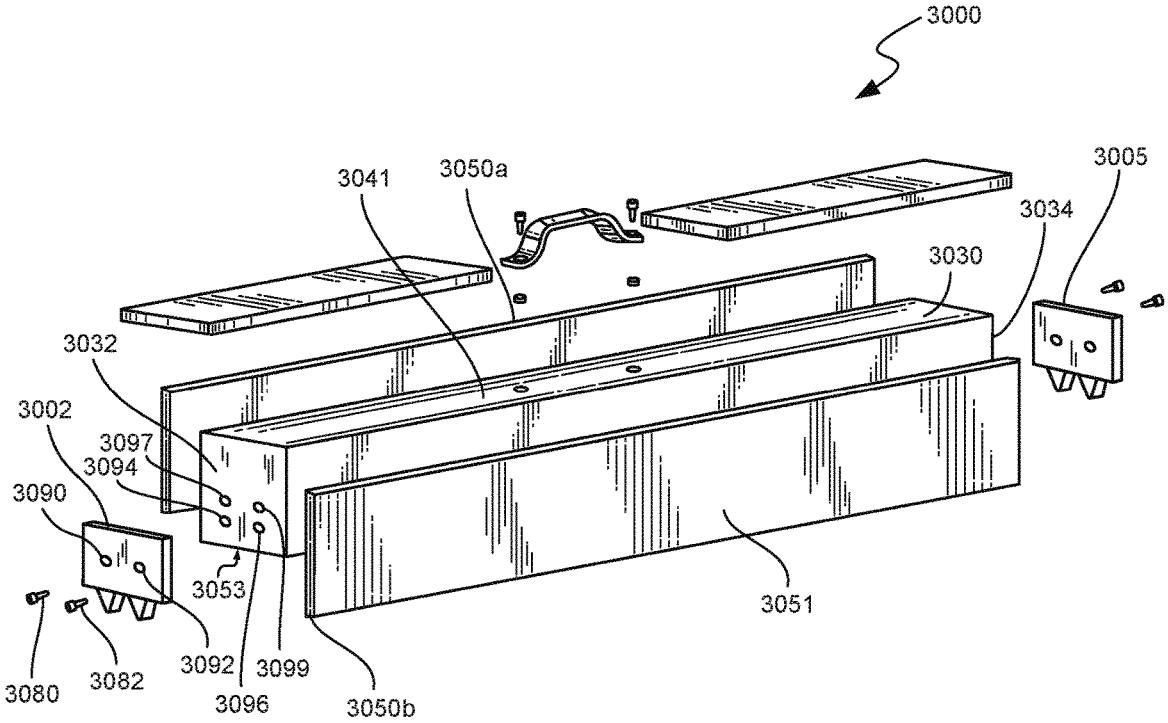
FIG. 47 is an exploded isometric view of a rebounding device with reversible endcap members in accordance with one embodiment of the technology.

FIGS. 46 and 47 together illustrate a rebounding device 3000 with reversible end members or endcap anchor plates 3002, 3005 ("endcap anchor plates 3002, 3005") in accordance with one embodiment of the technology. The endcap anchor plates 3002, 3005 can be moved to non-anchoring orientations 3007 (illustrated in dashed line for the end member 3002 in FIG. 46). The description of one of the endcap anchor plates 3002, 3005 applies equally to the other unless indicated otherwise.

Referring now to FIG. 47, the rebounding device 3000 can include a tubular frame 3030 having closed ends 3032, 3034 and a main body 3041. The rebounding device 3000 can include rebound member 3050*a*, 3050*b* coupled to opposing sides of the tubular frame 3030 such that exterior surfaces 3051 of the rebound members 3050*a*, 3050*b* are oriented vertically when the tubular frame 3030 rests on a horizontal support surface.

The anchor plates 3002, 3005 are each illustrated at a downward anchor orientation for on-ice use. The anchor plates 3002, 3005 can be removed, rotated (e.g., rotated 180 degree), and recoupled to the frame 3030 so that anchors (e.g., ground or ice-penetrating anchors 3040 of FIGS. 48A and 48B) extend upwardly and lay flat against the respective closed ends 3032, 3034 for off-ice use, transport, storage etc. The description of one anchor plates 3002, 3005 applies equally to the other unless indicated otherwise.

Figure 48B:
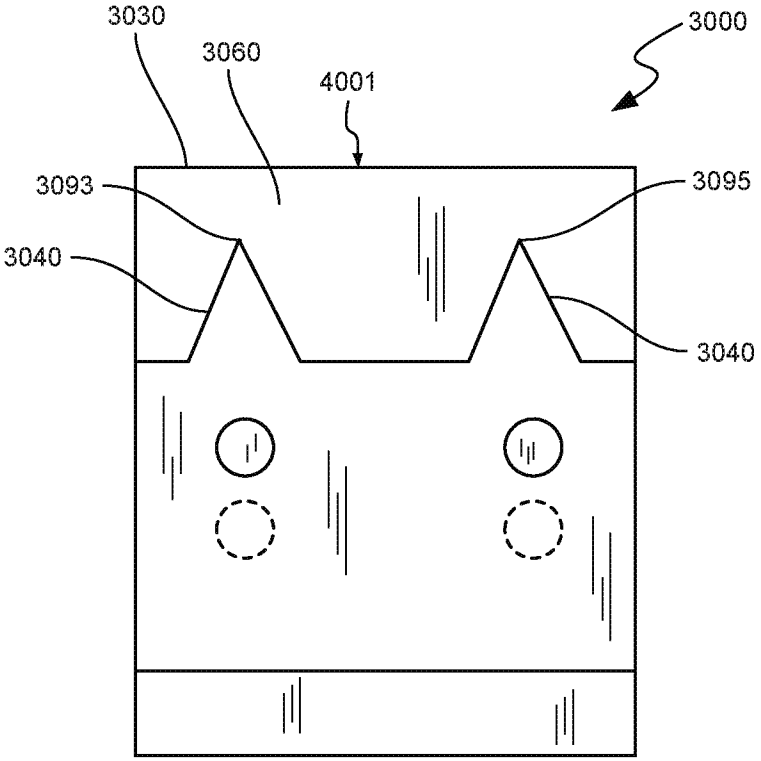
FIG. 48B is an end view is an end view of the rebounding device with an endcap member in a non-anchoring configuration and detachably coupled to the end of rebounding frame in accordance with one embodiment of the technology.
Figure 48A:
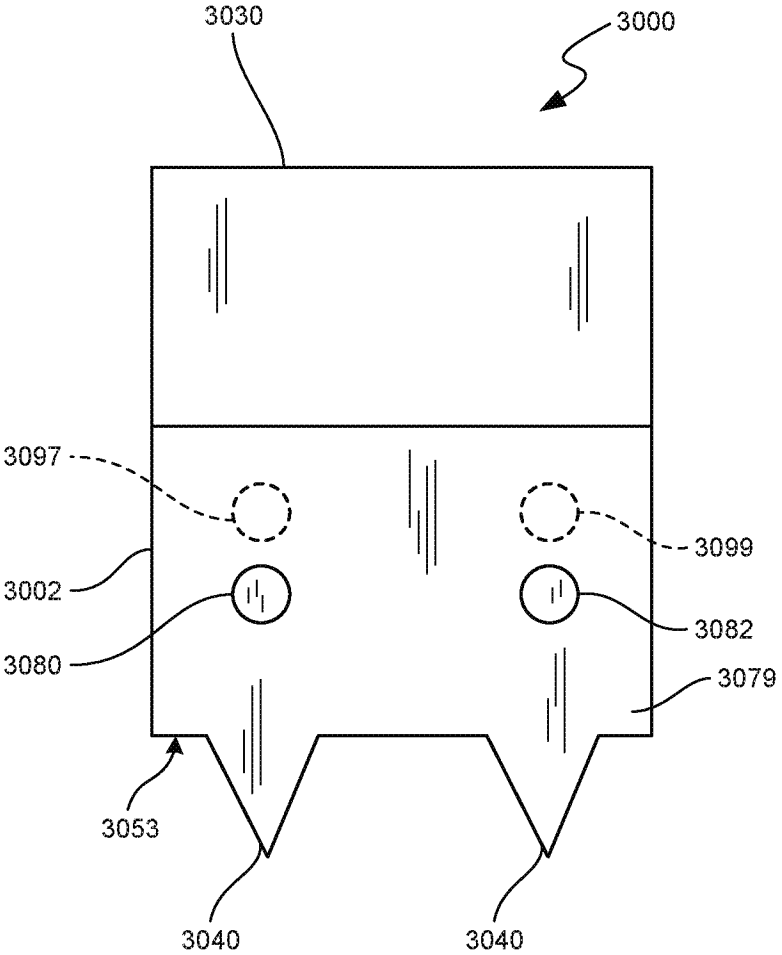
FIG. 48A is an end view of the rebounding device with an endcap member in an anchor deployed configuration and detachably coupled to the end of rebounding frame in accordance with one embodiment of the technology.

FIG. 48A is an end view of the rebounding device 3000 with the anchor plates 3002 in an anchoring configuration. FIG. 48B is an end view of the anchor plates 3002 in a non-anchoring or transport configuration. Referring now to FIG. 48A, the anchor plates 3002 can be a planar member/plate. For example, the anchor plates 3002 can includes a flat or planar main body 3079 integrally formed with ice-penetrating anchors 3040 via a machining process, stamping process, or the like. The configuration, number of anchors, anchor configurations, and other features of the anchor plate 3002 can be selected based on the configuration of the rebounding device 3000.

With continued reference to FIG. 48A, the anchors 3040 extend downwardly past a bottom surface 3053 of the frame member 3030, and fasteners 3080, 3082 can extend through openings 3090, 3092 (FIG. 47) of the anchor plate 3002 and openings 3094, 3096 in the endcap 3032. The fasteners 3080, 3082 can be removed from the frame member 3030 such that the anchor plate 3002 can be rotated and reinstalled by inserting the fasteners 3080, 3082 through respective openings 3090, 3092 of the anchor plate 3002 and respective openings 3097, 3099 of the endcap 3032. As shown in FIG. 48B, tips 3093, 3095 of the anchors 3040 can extend toward a top of the tubular frame 3030. The tips 3093, 3095 of the anchors 3040 in the non-penetrating position can be level with or below the upper surface 4001 to avoid inadvertent contact with tips 3093, 3095. The anchor plate 3002 can lay flush on an endcap surface 3060 when installed in either the anchor upward configuration or an anchor downward configuration.

The endcap members and features discussed in connection with FIGS. 46-49A can be used with other rebounding devices disclosed herein. For example, the endcap members of FIGS. 46-48B can be used with the rebounding device 100 discussed in connection with FIGS. 1-15, as well as other rebounding devices disclosed herein. The connections between the endcap members and the tubular frame can be selected based on the configuration of the frame.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. The description of one of the rebounding devices applies equally to other rebounding devices disclosed herein. For example, the friction pads 800 discussed in connection with FIGS. 31 and 32 can be used with the rebounding device 100 discussed in connection with FIGS. 1-7 and the rebounding device 400 discussed in connection with FIGS. 17-23B to allow the rebounding devices 100, 400 to be used for both on-ice and off-ice purposes. The friction pad could also act as an insulation barrier. The anchors discussed in connection with FIGS. 8 to 12 can be utilized with any of the embodiments discussed herein. Additionally, the anchors disclosed herein can be permanent or removable. For example, anchors in the form of retractable spikes can be used with pads or barriers disclosed herein. The spikes can extend through openings in the pads or barriers for on-ice use and can be retracted for off-ice uses. Alternatively, the anchors can be detachable anchors (e.g., spikes, cleats, etc.) that can be removed for off-ice uses. Rebounding devices can include a combination of retractable and removable anchors for installation flexibility.

The rebounding devices disclosed herein can add different configurations for use, transport, storage, or the like. For example, the rebounding device 2100 of FIGS. 40-45 has endcaps 2230 configured to be installed in a downward orientation (illustrated in FIG. 40) or an upward orientation. In the upward orientation, the anchors 2113 extend upwardly. For example, the endcap 2230 can remove from the frame of the rebounding device 2100. The endcaps 2230 can be rotated 180 degrees and then reinstalled on the frame for transport or use on a surface not suitable for use with anchors.

The description of one of the rebounding devices applies equally to other rebounding devices disclosed herein. For example, the friction pads 800 discussed in connection with FIGS. 31 and 32 can be used with the rebounding device 100 discussed in connection with FIGS. 1-7, rebounding device 400 discussed in connection with FIGS. 17-23B, and rebounding device 3000 of FIGS. 46-48B to allow the rebounding devices 100, 400, 3000 to be used for both on-ice and off-ice purposes. The friction pad could also act as an insulation barrier. The anchors discussed in connection with FIGS. 8 to 12 can be utilized with any of the embodiments discussed herein. Additionally, the anchors disclosed herein can be permanent or removable. For example, anchors in the form of retractable spikes can be used with pads or barriers disclosed herein. The spikes can extend through openings in the pads or barriers for on-ice use and can be retracted for off-ice uses. Alternatively, the anchors can be detachable anchors (e.g., spikes, cleats, etc.) that can be removed for off-ice uses. Rebounding devices can include a combination of retractable and removable anchors for installation flexibility.

Features and components of various systems and devices disclosed herein can be mixed and matched to provide desired functionality. By way of another example, the strap system 310 discussed in connection with FIG. 16 can be utilized with any of the rebounding devices discussed herein. Rebounding devices disclosed herein can have couplers, pins, integrated slots, magnets, or other coupling elements for coupling rebounding devices together. A number, a configuration, and a location of the coupling elements can be selected based on the configuration of the rebounding devices. Additionally, it is contemplated that various aspects and features of the invention described can be practiced separately, combined together, or substituted for one another, and that a variety of combination and sub-combinations of the features and aspects can be made and still fall within the scope of the invention. Thus, it is intended that the scope of the present invention herein disclosed should not be limited by the particular disclosed embodiments described above, but should be determined only by a fair reading of the claims.

What is claimed is:

1. A portable hockey-training device for rebounding a playing object, comprising:

a tubular frame including a bottom, a side, a first end, and a second end;

a rebound member coupled to the side and including a surface facing away from the tubular frame such that the surface is oriented vertically when the portable hockey-training device is supported by a horizontal playing surface;

a first endcap anchor plate including one or more first ice-penetrating anchors and being detachably coupleable to the first end; and a second endcap anchor plate including one or more second ice-penetrating anchors and being detachably coupleable to the second end, wherein the first and second endcap anchor plates are configured to be coupled to the respective first and second ends for on-ice use and to be separated from the tubular frame and reinstalled on the tubular frame in a non-penetrating position for off-ice use.

2. The portable hockey-training device of claim 1, wherein the first endcap anchor plate is configured to lay flush on a surface of the first end when installed in an anchor upward configuration for off-ice use and an anchor downward configuration for on-ice use.

3. A portable hockey-training device for rebounding a playing object, comprising:

a tubular frame including a bottom, a side, a first end, and a second end;

a rebound member coupled to the side and including a rebounding surface facing away from the tubular frame;

a first end member including one or more first ice-penetrating anchors and being detachably coupleable to the tubular frame; and a second end member including one or more second ice-penetrating anchors and being detachably coupleable to the tubular frame, wherein the first end anchor member is configured to be coupled to the tubular frame for on-ice use when the rebound member is positioned to rebound an on-ice playing object and to be separated from the tubular frame for off-ice use.

4. The portable hockey-training device of claim 3, wherein the first end member is configured to be coupled to the first end in an ice-penetrating anchor upward configuration and an ice-penetrating anchor downward configuration.

5. The portable hockey-training device of claim 3, wherein the one or more first ice-penetrating anchors extend upwardly when the first end member is installed in an ice-penetrating anchor upward configuration and a bottom of the portable hockey-training device is supported by a horizontal surface, and the one or more first ice-penetrating anchors extend downwardly when the first end member is installed in an ice-penetrating anchor downward configuration and the portable hockey-training device is supported by the horizontal surface.

6. The portable hockey-training device of claim 3, wherein in an anchor upward configuration, the one or more first ice-penetrating anchors lay along an endcap of the tubular frame, and in an anchor downward configuration, the one or more first ice-penetrating anchors extend downwardly from the tubular frame when the tubular frame is supported by the horizontal surface.

7. The portable hockey-training device of claim 6, wherein the one or more first ice-penetrating anchors are positioned below a top of the tubular frame when in an ice-penetrating anchors are in the anchor upward configuration.

8. The portable hockey-training device of claim 3, wherein the rebound member extends along most of a longitudinal length of the tubular frame, and wherein the rebound member includes a bottom edge positioned to be substantially flush an ice surface when the first and/or second ice-penetrating anchors are seated in ice.

9. The portable hockey-training device of claim 3, further comprising:

at least one first fastener configured for removably coupling the first end member to the first end of the tubular frame, and at least one second fastener configured for removably coupling the second end member to the second end of the tubular frame.

10. A portable hockey-training device for rebounding a playing object, comprising:

a tubular frame including a bottom, a side, a first end, and a second end;

a rebound member coupled to the side and including a rebounding surface facing away from the tubular frame:

a first end member including one or more first ice-penetrating anchors and being detachably coupleable to the first end; and a second end member including one or more second ice-penetrating anchors and being detachably coupleable to the second end, wherein the first end anchor member is configured to be coupled to the first end for on-ice use and to be separated from the tubular frame for off-ice use wherein the first end includes:

a pair of lower holes configured to receive respective fasteners to couple the first end member to the first end such that the one or more first ice-penetrating anchors protrude past the bottom, and a pair of upper holes configured to receive respective fasteners to couple the first end member to the first end such that the one or more first ice-penetrating anchors overlay the first end.

11. The portable hockey-training device of claim 3, wherein the first end member includes a plate integrally formed with the one or more first ice-penetrating anchors.

12. The portable hockey-training device of claim 3, wherein at least one of the first end or the second end covers an end portion of the tubular frame.

13. A hockey-training device for rebounding a playing object, comprising:

a tubular frame including a first closed end, a second closed end, and a main body extending between the first and second closed ends, the main body includes a bottom, a first side configured to be substantially perpendicular to a playing surface and which the hockey training-device rests, and a second side, a rebound member coupled to the first side; and a pair of end members detachably coupleable to respective ones of first and second closed ends of the tubular frame and including one or more ice-penetrating anchors, wherein each of the end members are configured to be coupled to the opposing first and second closed ends in a first configuration for on-ice use when the one or more ice-penetrating anchors extend downward and a second configuration for off-ice use, transport, or storage when the one or more ice-penetrating anchors extend upward.

14. The hockey-training device of claim 13, wherein the first end member is configured to be coupled to the first end in an anchor upward configuration and an anchor downward configuration.

15. The hockey-training device of claim 13, wherein in an anchor upward configuration, the one or more ice-penetrating anchors extend upwardly when the tubular frame is supported by a horizontal surface, and in an anchor downward configuration, the one or more ice-penetrating anchors extend downwardly when the tubular frame is supported by the horizontal surface.

16. The hockey-training device of claim 15, wherein the one or more ice-penetrating anchors are positioned below a top of the tubular frame when in the anchor upward configuration.

17. The hockey-training device of claim 13, wherein the rebound member extends along most of a longitudinal length of the elongate tubular frame, and wherein the rebound panel includes a bottom edge positioned to be substantially flush with the ice surface when the one or more ice-penetrating anchors are seated in ice.

18. The hockey-training device of claim 13, further comprising at least one first fastener configured for removably coupling one of the end members to the first end of the elongate tubular frame, and at least one second fastener configured for removably coupling the one of the end members to the first end of the elongate tubular frame.

19. The hockey-training device of claim 13, wherein at least one of the end members is a first end member that includes:

a pair of lower holes configured to receive respective fasteners to couple the first end member to the first end such that one or more ice-penetrating anchors of the first end member protrude from the bottom, and a pair of upper holes configured to receive respective fasteners to couple the first end member to the first end such that the one or more ice-penetrating anchors of the first end member extend toward a top of the tubular frame.

20. The hockey-training device of claim 13, wherein each end member includes a plate integrally formed with the one or more ice-penetrating anchors.

* * * * *